US007667195B2

(12) United States Patent
Vestal

(10) Patent No.: US 7,667,195 B2
(45) Date of Patent: Feb. 23, 2010

(54) HIGH PERFORMANCE LOW COST MALDI MS-MS

(75) Inventor: Marvin L. Vestal, Framingham, MA (US)

(73) Assignee: Virgin Instruments Corporation, Sudbury, MA (US)

( * ) Notice: Subject to any disclaimer, the term of this patent is extended or adjusted under 35 U.S.C. 154(b) by 506 days.

(21) Appl. No.: 11/742,714

(22) Filed: May 1, 2007

(65) Prior Publication Data

US 2008/0272287 A1 Nov. 6, 2008

(51) Int. Cl.
*H01J 49/40* (2006.01)

(52) U.S. Cl. ..... 250/287; 250/281; 250/282

(58) Field of Classification Search ..... 250/281, 250/282, 283, 286, 287, 288
See application file for complete search history.

(56) References Cited

U.S. PATENT DOCUMENTS

| | | | | |
|---|---|---|---|---|
| 4,730,111 | A | | 3/1988 | Vestal et al. |
| 4,731,533 | A | | 3/1988 | Vestal |
| 4,766,312 | A | | 8/1988 | Fergusson et al. |
| 4,814,612 | A | | 3/1989 | Vestal et al. |
| 4,861,989 | A | | 8/1989 | Vestal et al. |
| 4,883,958 | A | | 11/1989 | Vestal |
| 4,902,891 | A | | 2/1990 | Vestal |
| 4,958,529 | A | | 9/1990 | Vestal |
| 4,960,992 | A | | 10/1990 | Vestal et al. |
| 5,015,845 | A | | 5/1991 | Allen et al. |
| 5,160,840 | A | * | 11/1992 | Vestal ..... 250/287 |
| 5,498,545 | A | | 3/1996 | Vestal |
| 5,625,184 | A | | 4/1997 | Vestal et al. |
| 5,627,369 | A | | 5/1997 | Vestal et al. |
| 5,760,393 | A | | 6/1998 | Vestal et al. |
| 5,994,695 | A | * | 11/1999 | Young ..... 250/287 |
| 6,002,127 | A | | 12/1999 | Vestal et al. |
| 6,057,543 | A | | 5/2000 | Vestal et al. |
| 6,175,112 | B1 | | 1/2001 | Karger et al. |
| 6,281,493 | B1 | | 8/2001 | Vestal et al. |
| RE37,485 | E | | 12/2001 | Vestal |
| 6,348,688 | B1 | | 2/2002 | Vestal |
| 6,414,306 | B1 | | 7/2002 | Mayer-Posner et al. |

(Continued)

FOREIGN PATENT DOCUMENTS

| | | |
|---|---|---|
| GB | 2 370 114 | 6/2002 |

(Continued)

OTHER PUBLICATIONS

R. Kaufmann, et al., "Sequencing of Peptides in a Time-of-Flight Mass Spectrometer-Evaluation of Postsource Decay . . . ," Int. J. Mass Spectrom. Ion Process. 131: 355-385 (1994).

(Continued)

*Primary Examiner*—Jack I Berman
*Assistant Examiner*—Nicole Ippolito Rausch
(74) *Attorney, Agent, or Firm*—Kurt Rauschenbach; Rauschenbach Patent Law Group, LLC

(57) ABSTRACT

The invention comprises apparatus and methods for rapidly and accurately determining mass-to-charge ratios of molecular ions produced by a pulsed ionization source, and for fragmenting all of the molecular ions produced and rapidly and accurately determining the intensities and mass-to-charge ratios of the fragments produced from each molecular ion.

24 Claims, 21 Drawing Sheets

U.S. PATENT DOCUMENTS

| | | | | |
|---|---|---|---|---|
| 6,441,369 | B1 | 8/2002 | Vestal et al. | |
| 6,504,150 | B1 | 1/2003 | Verentchikov et al. | |
| 6,512,225 | B2 | 1/2003 | Vestal et al. | |
| 6,534,764 | B1 * | 3/2003 | Verentchikov et al. | 250/287 |
| 6,541,765 | B1 | 4/2003 | Vestal | |
| 6,621,074 | B1 | 9/2003 | Vestal | |
| 6,670,609 | B2 | 12/2003 | Franzen et al. | |
| 6,674,070 | B2 | 1/2004 | Karger et al. | |
| 6,770,870 | B2 | 8/2004 | Vestal | |
| 6,825,463 | B2 | 11/2004 | Karger et al. | |
| 6,831,270 | B2 | 12/2004 | Furuta et al. | |
| 6,844,545 | B1 | 1/2005 | Hutchins et al. | |
| 6,900,061 | B2 | 5/2005 | Smirnov et al. | |
| 6,918,309 | B2 | 7/2005 | Brock et al. | |
| 6,933,497 | B2 | 8/2005 | Vestal | |
| 6,952,011 | B2 | 10/2005 | Brown et al. | |
| 6,953,928 | B2 | 10/2005 | Vestal et al. | |
| 6,995,363 | B2 | 2/2006 | Donegan et al. | |
| 7,030,373 | B2 | 4/2006 | Vestal et al. | |
| 7,064,319 | B2 | 6/2006 | Hashimoto et al. | |
| 7,109,480 | B2 | 9/2006 | Vestal et al. | |
| RE39,353 | E | 10/2006 | Vestal | |
| 7,176,454 | B2 | 2/2007 | Hayden, et al. | |
| 2003/0006369 | A1 * | 1/2003 | Bryden | 250/281 |
| 2003/0057368 | A1 | 3/2003 | Franzen et al. | |
| 2003/0116707 | A1 | 6/2003 | Brown et al. | |
| 2005/0031496 | A1 | 2/2005 | Laurell et al. | |
| 2005/0087685 | A1 | 4/2005 | Bouvier et al. | |
| 2005/0130222 | A1 | 6/2005 | Lee | |
| 2005/0178959 | A1 | 8/2005 | Lopez-Avila et al. | |
| 2006/0266941 | A1 | 11/2006 | Vestal | |
| 2006/0273252 | A1 | 12/2006 | Hayden et al. | |
| 2007/0038387 | A1 | 2/2007 | Chen et al. | |
| 2007/0054416 | A1 | 3/2007 | Regnier et al. | |

FOREIGN PATENT DOCUMENTS

| | | | |
|---|---|---|---|
| WO | WO 2004/018102 | A1 | 3/2004 |
| WO | WO 2005/061111 | A2 | 7/2005 |

OTHER PUBLICATIONS

J. Preisler, et al., "Capillary Array Electrophoresis-MALDI Mass Spectrometry using a Vacuum Deposition Interface," Anal. Chem. 74: 17-25 (2002).

R. L. Caldwell and R. M. Caprioli, "Tissue Profiling by Mass Spectrometry," MCP 4: 394-401 (2005).

M. L. Vestal, et al., "Delayed Extraction Matrix-Assisted Laser Desorption Time-of-Flight Mass Spectrometry," Rapid Comm. Mass Spectrom. 9: 1044-1050 (1995).

M. L. Vestal and P. Juhasz, "Resolution and Mass Accuracy in Matrix-Assisted Laser Desorption Time-of-Flight Mass Spectrometry," J. Am. Soc. Mass Spectrom. 9: 892-911 (1998).

E. J. Takach, et al., "Accurate Mass Measurement using MALDI-TOF with Delayed Extraction," J. Prot. Chem. 16: 363-369 (1997).

D. J. Beussman, et al., "Tandem Reflectron Time-of-Flight Mass Spectrometer Utilizing Photodissociation," Anal. Chem. 67: 3952-3957 (1995).

M. L. Vestal, "High-Performance Liquid Chromatography-Mass Spectrometry," Science 226: 275-281 (1984).

* cited by examiner

HIGH PERFORMANCE LOW COST MALDI MS-MS

BACKGROUND OF THE INVENTION

Many applications require accurate determination of the molecular masses and relative intensities of metabolites, peptides and intact proteins in complex mixtures. Time-of-flight (TOF) with reflecting analyzers provides excellent resolving power, mass accuracy, and sensitivity at lower masses (up to 5-10 kda), but performance is poor at higher masses primarily because of substantial fragmentation of ions in flight. At higher masses, simple linear TOF analyzers provide satisfactory sensitivity, but resolving power and mass accuracy are low. A TOF mass analyzer combining the best features of reflecting and linear analyzers is required for these applications.

An important advantage of TOF mass spectrometry (MS) is that essentially all of the ions produced are detected, unlike scanning MS instruments. This advantage is lost in conventional MS-MS instruments where each precursor is selected sequentially and all non-selected ions are lost. This limitation can be overcome by selecting multiple precursors following each laser shot and recording fragment spectra from each can partially overcome this loss and dramatically improve speed and sample utilization without requiring the acquisition of raw spectra at a higher rate.

All of these improvements will have limited impact unless the instruments are reliable, cost-effective, and very easy to use. Improvements in instrumentation which affect each of these issues are found in the present invention.

Several approaches to matrix assisted laser desorption/ionization (MALDI)-TOF MS-MS are described in the prior art. All of these are based on the observation that at least a portion of the ions produced in the MALDI ion source may fragment as they travel through a field-free region. Ions may be energized and caused to fragment as the result of excess energy acquired during the initial laser desorption process, or by energetic collisions with neutral molecules in the plume produced by the laser, or by collisions with neutral gas molecules in the field-free drift region. These fragment ions travel through the drift region with approximately the same velocity as the precursor, but their kinetic energy is reduced in proportion to the mass of the neutral fragment that is lost. A timed-ion-selector may be placed in the drift space to transmits a small range of selected ions and reject all others. In a TOF analyzer employing a reflector, the lower energy fragment ions penetrate less deeply into the reflector and arrive at the detector earlier in time than the corresponding precursors. Conventional reflectors focus ions in time over a relatively narrow range of kinetic energies; thus only a small mass range of fragments are focused for given potentials applied to the reflector.

In the pioneering work by Spengler and Kaufmann this limitation was overcome by taking a series of spectra at different mirror voltages and piecing them together to produce the complete fragment spectrum. An alternate approach is to use a "curved field reflector" that focuses the ions in time over a broader energy range. The TOF-TOF approach employs a pulsed accelerator to re-accelerate a selected range of precursor ions and their fragments so that the energy spread of the fragments is sufficiently small that the complete spectrum can be adequately focused using a single set of reflector potentials. All of these approaches have been used to successfully produce MS-MS spectra following MALDI ionization, but each suffers from serious limitations that have stalled widespread acceptance. For example, each involves relatively low-resolution selection of a single precursor, and generation of the MS-MS spectrum for that precursor, while ions generated from other precursors present in the sample are discarded. Furthermore, the sensitivity, speed, resolution, and mass accuracy for the first two techniques are inadequate for many applications.

SUMMARY OF THE INVENTION

The invention comprises apparatus and methods for rapidly and accurately determining mass-to-charge ratios of molecular ions produced by a pulsed ionization source, and for fragmenting the molecular ions produced and rapidly and accurately determining the intensities and mass-to-charge ratios of the fragments produced from each molecular ion.

The apparatus comprises a pulsed ion source, a field-free drift space, a two-stage ion reflector, a baffle in the field-free drift space adjacent to the mirror with an aperture for admitting ions to the mirror and a second aperture for allowing ions to exit the mirror, a deflection means for directing ions from the source to the entrance aperture in the baffle and an ion detector located to detect ions passing through the exit aperture.

In contrast to the prior art, a timed-ion-selector is not required for selecting precursor ions, although in some embodiments one may be provided. The distances and voltages employed in the apparatus are selected so that ions produced in the ion source are focused in time at the detector so that the time-of-flight is independent of kinetic energy to second order. Furthermore, the entrance aperture positions and sizes are chosen so that only ions with sufficient kinetic energy to reach the second stage of the reflector are detected.

In the present invention multiple segments of fragment spectra are required, each segment corresponding to a particular range of the ratio of fragment mass to precursor mass; but unlike the prior art, accurate fragment ion masses are determined simultaneously for fragments present due to all of the precursor ions in the spectrum. Thus although 10-15 segments may be required to generate a complete fragment spectrum, 100 or more precursors can be fragmented without sacrificing sensitivity or mass accuracy.

In one embodiment a pulse rate of 5 khz is employed, allowing data to be acquired much faster than in existing TOF instruments typically limited to rates of 200 hz or less. Any combination of the key elements of the TOF analyzer can be employed in this invention but in a preferred embodiment these elements are combined to optimize the sensitivity, dynamic range, and mass accuracy for both precursors and fragments.

In addition to the key elements of the TOF analyzer, a computer algorithm is used to process the measured TOF spectra to first determine abundance, centroid, and standard deviation of all significant peaks in the spectrum and then to assign these peaks to the correct monoisotopic precursor and fragment masses.

In one embodiment the pulsed ion source is a matrix assisted laser desorption/ionization source (MALDI) employing time lag focusing. In one embodiment the MALDI source employs a laser operating at 5 khz. In one embodiment the electrical field adjacent to the sample plate in the MALDI source is approximately equal to the maximum value that can be sustained without initiating an electrical discharge.

In one embodiment this electrical field is approximately 30 kV/cm.

In one embodiment the ion reflector comprises a two-stage gridded ion mirror.

In one embodiment the length of each stage of the mirror is substantially equal to 1/16 of the length of the field-free region less the focal length of the ion source.

In one embodiment the electric field strength in the first stage of the ion mirror is substantially equal to three times the field strength in the second stage.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
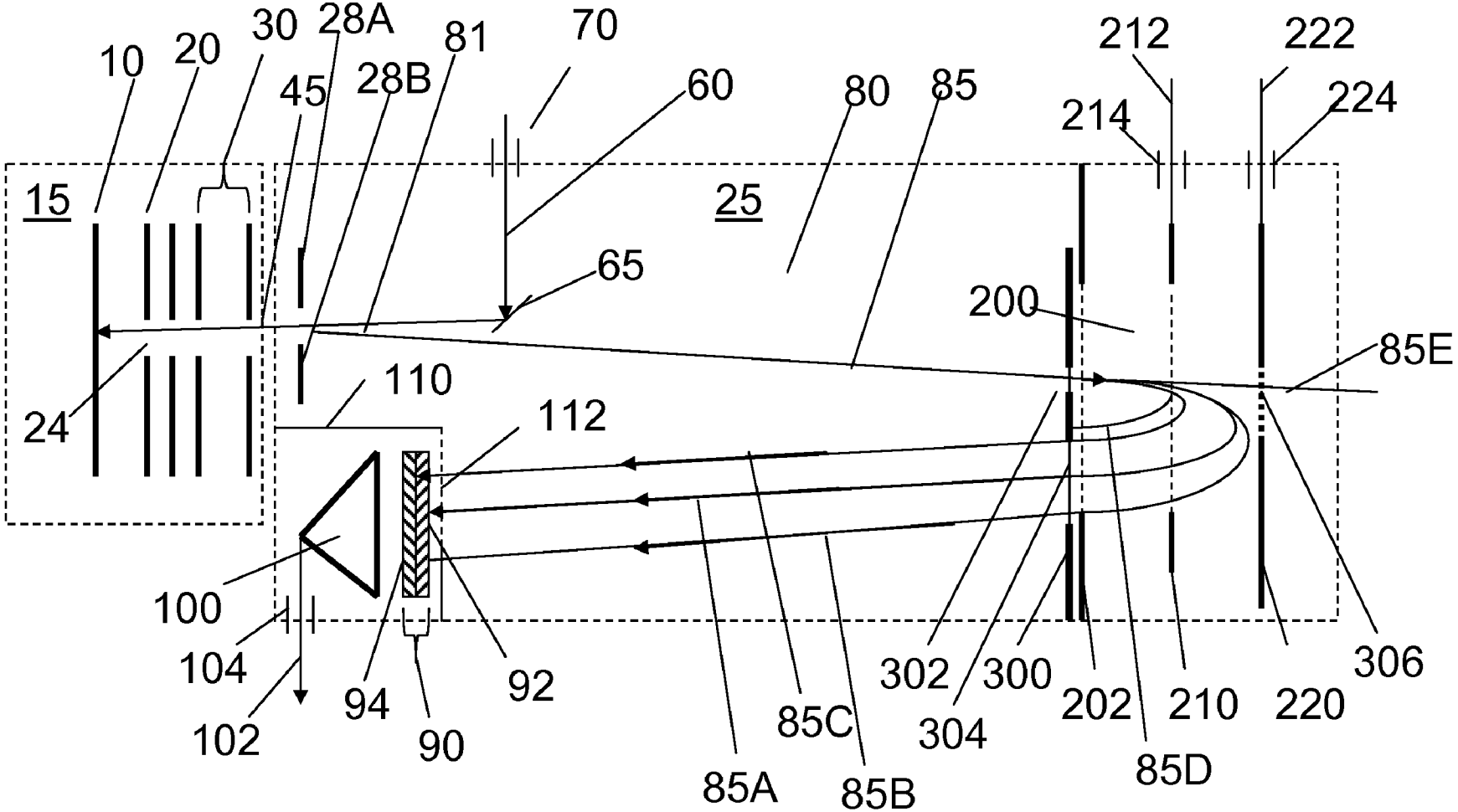
FIG. 1 is a schematic diagram of one embodiment of the invention.

A description of preferred embodiments of the invention follows. Referring now to FIG. 1. A MALDI sample plate 10 with samples of interest in matrix crystals on the surface is installed within an evacuated ion source housing 15 and a sample of interest is placed in the path of pulsed laser beam 60 which enters through a window 70 in the analyzer vacuum housing, and is reflected by mirror 65. As used herein, a "MALDI sample plate" or "sample plate" refers to the structure onto which the samples are deposited. Such sample plates are disclosed and described in copending U.S. application Ser. No. 11/541,467 filed Sep. 29, 2006, the entire disclosure of which is incorporated herein by reference.

At a certain or selected time following the laser pulse, a high-voltage pulse 12 (shown in FIG. 2) is applied to the sample plate 10 producing an electric field between sample plate 10 and extraction electrode 20 at ground potential causing a pulse of ions to be accelerated. The ions pass through the extraction electrode aperture 24 and through a first field-free space or region 30 and gate valve 45 in the open position, and into analyzer vacuum housing 25.

Deflection electrodes 28A and 28B are energized to direct ion beam 85 through the field-free space or region 80 located within the analyzer vacuum housing toward baffle aperture 302 in baffle 300. Ions with a predetermined kinetic energy V are reflected by a two-stage gridded ion mirror 200 (comprising electrodes 202, 210 and 220 in the Figure) and exit the mirror near the center of a second baffle aperture 304 and travel through the field-free space 80 along a first ion trajectory 85A then pass through a grid 112 built into the detector unit and strike the input surface 92 of the detector 90 which is housed in housing 110. In one embodiment the detector comprises a dual channel plate electron multiplier having an input surface 92 and an output surface 94. Each ion impinging on the input surface 92 produces a large number of electrons (ca. 1 million) in a narrow pulse at the output surface 94. The gain of the electron multiplier is determined by the bias voltage $V_d$ applied across the dual channel plate. The electrons are accelerated by the electric field between the output surface 94 and the anode 100 at ground potential, and strike the anode producing an electrical pulse that is coupled through an electrical feedthrough 104 in the wall of the analyzer vacuum housing 25 and connected to the input of a digitizer (not shown).

Ions with substantially lower kinetic energy than the predetermined value V penetrate a shorter distance into the ion mirror and strike the baffle plate 300 as indicated by the fourth ion trajectory 85D.

Ions with substantially higher kinetic energy than V pass through gridded aperture 306 in mirror electrode 220, and are not reflected. Electrode 220 receives voltage via feedthrough 222 in aperture 224. Likewise, mirror electrode 210 receives voltage via feedthrough 212 in aperture 214.

Ions within a predetermined kinetic energy range closer to V pass through aperture 304 along second and third ion trajectories 85B and 85C and are detected by detector 90.

Figure 2:
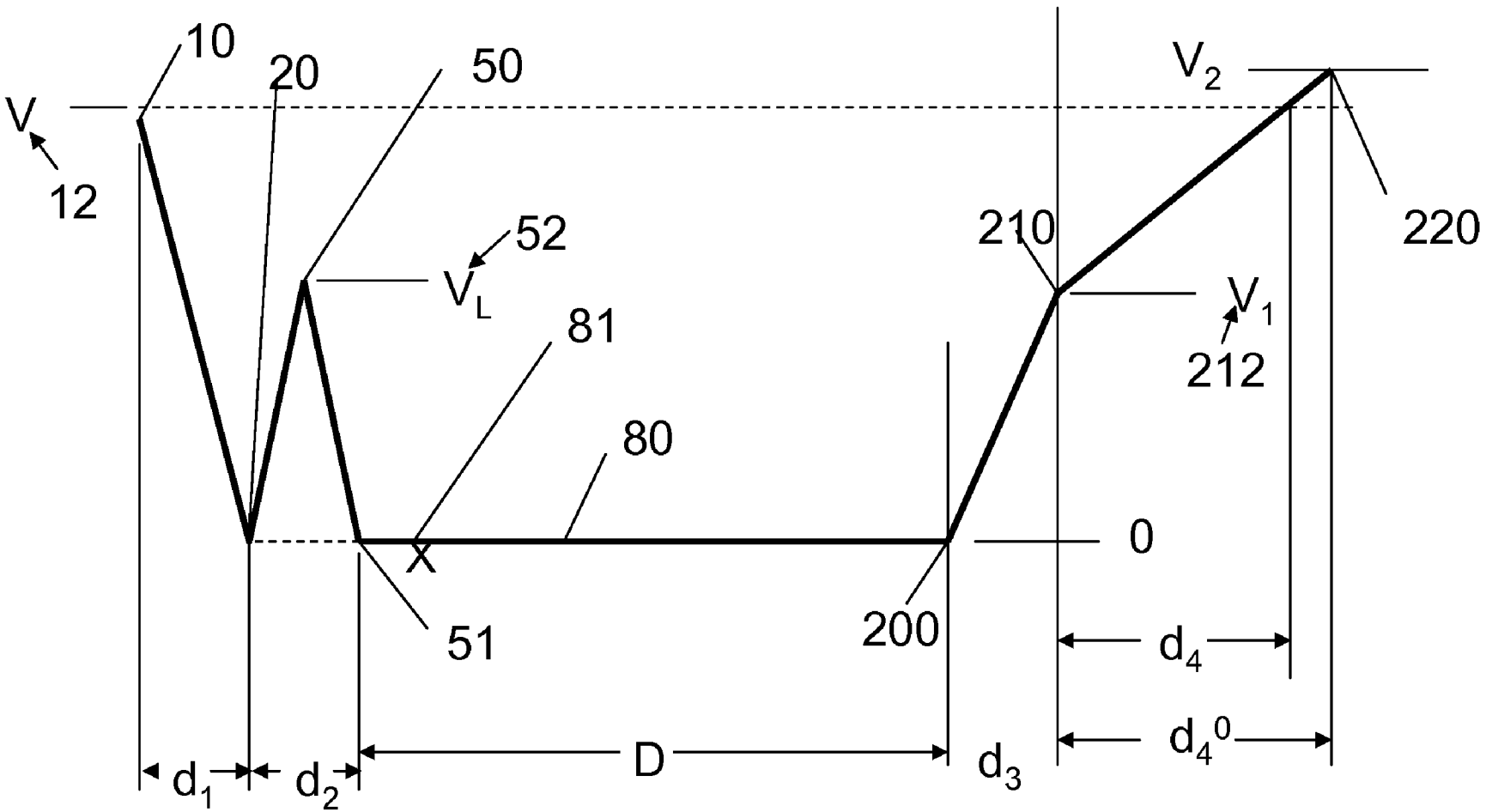
FIG. 2 is a potential diagram for the embodiment depicted in FIG. 1.

FIG. 2 represents a potential diagram for one embodiment of the invention. The distances noted on the figure include $d_1$, the length of the first accelerating region between the MALDI sample plate 10 and the extraction electrode 20; $d_2$, the length of the focusing lens; D, of the field-free region 80; and the lengths $d_3$ and $d_4$ of the first and second stages, respectively, of the two stage gridded ion mirror.

The overall length of the analyzer is the sum of these distances plus any additional required for the ion source and analyzer vacuum housings.

In one embodiment the length D of the field free drift space (i.e., drift tube) 80 is large compared to the sum of the other distances, and $d_1$ is small as practical without initiating electrical discharge within the vacuum system.

In one embodiment the mirror dimensions and operating voltages are chosen so that the time required for ions to travel from a predetermined focal point 81 in the field-free region 80, be reflected by the mirror, and reach the detector is independent of the energy of the ions to both first and second order. First and second order focusing in a reflector requires satisfying the following equations:

$$4d_3/D_m=1-3/w \quad (1)$$

$$4d_4/D_m=w^{-3/2}+(4d_3/D_m)/(w+w^{1/2}) \quad (2)$$

where $D_m$ is the total length of the ion path from the focal point 81 to the entrance of mirror 200 plus the path from the mirror exit to the detector input surface 92, $d_3$ is the length of the first region of the mirror, $d_4$ is the distance than an ion with initial energy V penetrates into the second region of the mirror and $w=V/(V-V_1)$ is the ratio of the ion energy at the entrance to the mirror to that at the entrance to the second region with the intermediate electrode at potential $V_1$. Thus, first and second order focusing can be achieved for any value of w>3, and the corresponding distance ratios are uniquely determined by equations (1) and (2). For predetermined values of $d_3$ and $D_m$, voltage $V_1$ 212 applied to mirror electrode 210 is adjusted to satisfy equation (1) and voltage $V_2$ 222 applied to mirror electrode 220 is adjusted to satisfy equation (2), where $$d_4=d_4^0(V-V_1)/(V_2-V_1) \quad (3)$$

Figure 3:
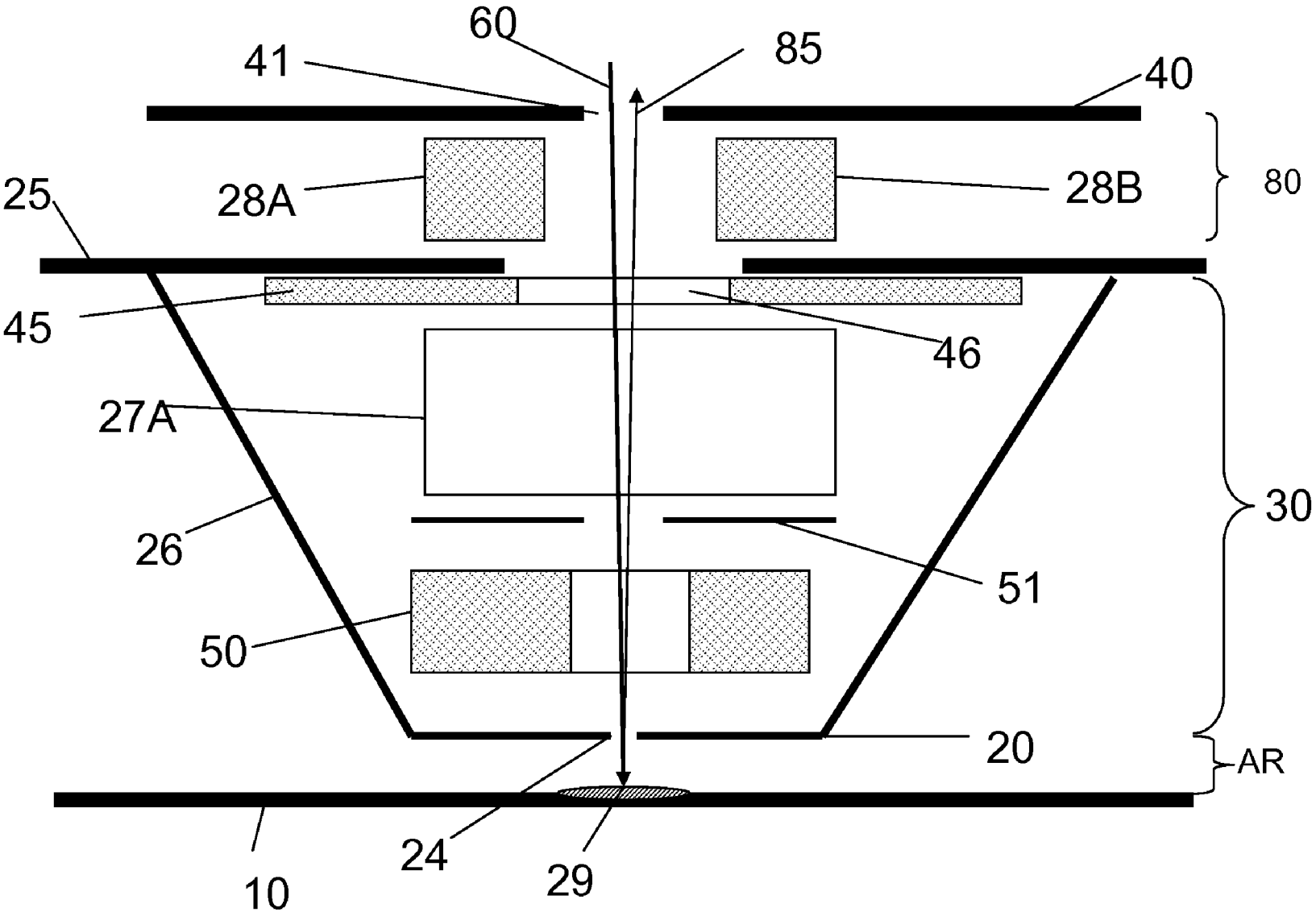
FIG. 3 illustrates cross-sectional detail of one embodiment employing single-stage acceleration in the ion source.

FIG. 3 shows a partial cross-sectional detail of one embodiment comprising the accelerating region ("AR") between the MALDI sample plate 10 and the grounded extraction electrode 20, the first field-free region 30 between the extraction electrode 20 and the analyzer vacuum housing 25, and the first portion of the second field-free region 80 between the analyzer source housing 25 and grounded electrode 40. In some embodiments the first field-free region is enclosed in a grounded shroud 26. Included within the first field-free region are gate valve 45 (having aperture 46), and deflection electrodes 27 and 28. In the cross-sectional view 27A is below the plane of the drawing and 27B is above the plane of the drawing (not shown). Deflection electrodes 28A and 28B are located in the field-free region between the analyzer vacuum housing 25 and acceleration electrode 40, having aperture 41.

Voltage may be applied to one or more of the electrodes, 27A, 27B, 28A, and 28B to deflect ions in the ion beam 85 produced by the pulsed laser beam 60 striking sample 29 deposited on the surface of the MALDI plate 10. A voltage difference between 27A and 27B deflects the ions in a direction perpendicular to the plane of the drawing, and a voltage difference between 28A and 28B deflects ions in the plane of the drawing to direct the ion beam 85 toward aperture 302 in baffle 300.

Voltages can be applied as necessary to correct for misalignments in the ion optics and to direct ions along a preferred path. Also, a time dependent voltage can be applied to one or more of the deflection electrodes to deflect ions within predetermined mass ranges so that they cannot reach aperture 302 and to allow ions in other predetermined mass ranges to pass through aperture. Electrodes 50 and 51 together with the extraction electrode 20 comprise an einzel lens that may be energized by applying voltage $V_L$ 52 to electrode 50 to focus the ion beam 85 so that substantially all of the ions pass through aperture 302.

Figure 4:
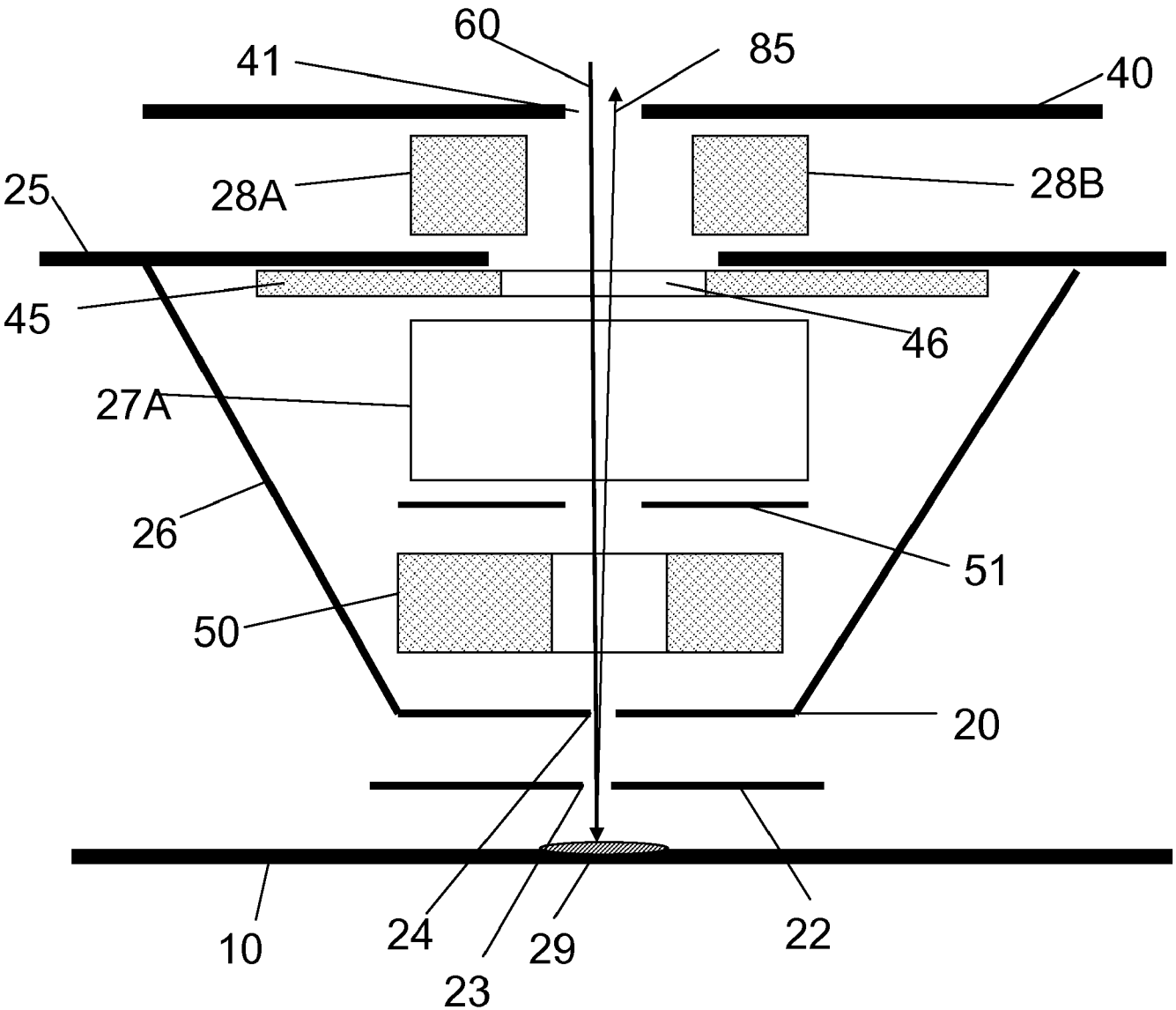
FIG. 4 illustrates cross-sectional detail of one embodiment employing two-stage acceleration in the ion source.

FIG. 4 represents an alternative embodiment employing two-stage acceleration in the ion source. Additional electrode 22 with aperture 23 aligned with the laser beam 60 is installed between the sample plate 10 and grounded plate 20.

Figure 5:
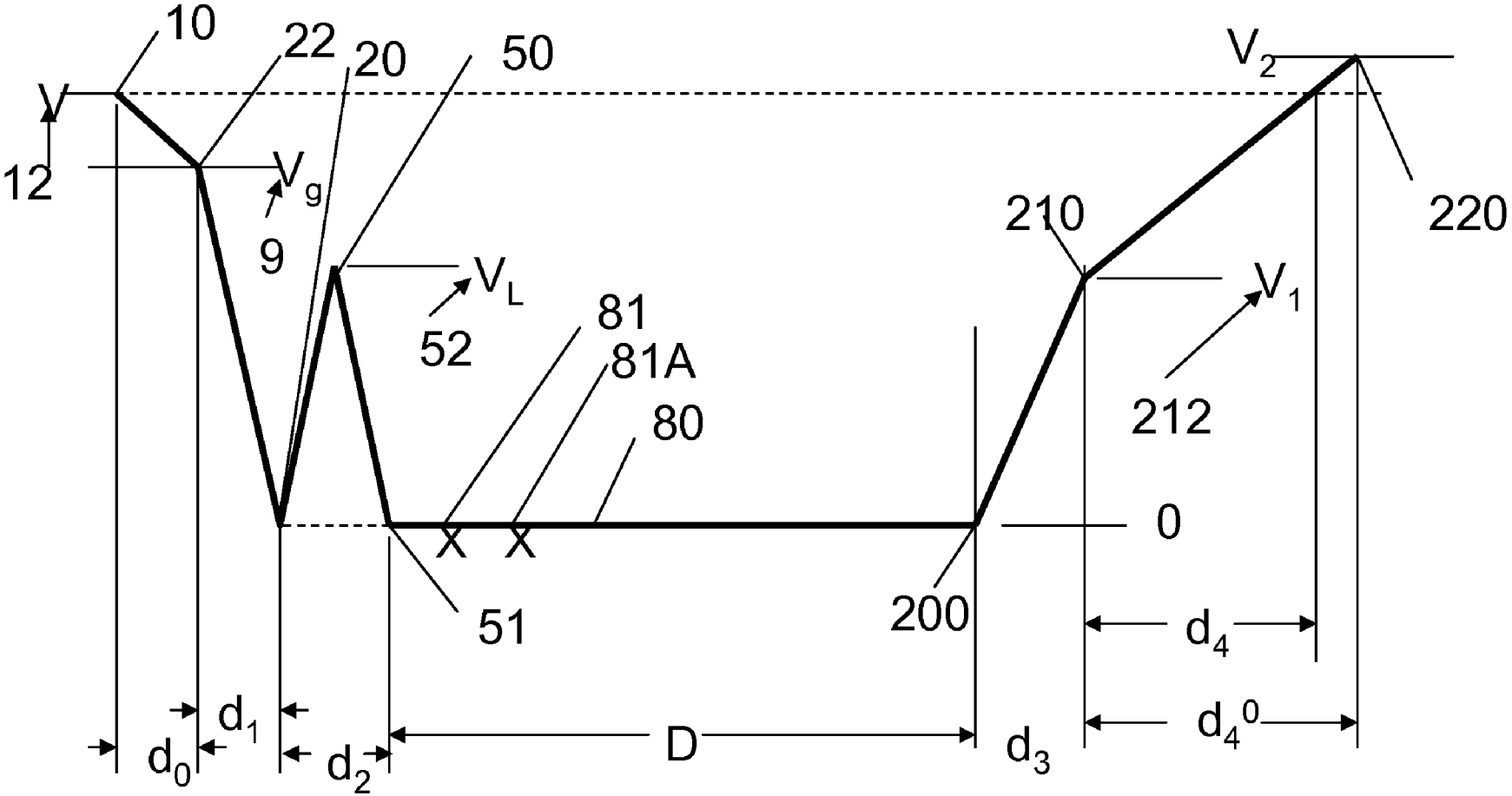
FIG. 5 is a potential diagram for the embodiment employing a two-stage acceleration in the ion source.

A potential diagram for this embodiment is shown in FIG. 5. Potential $V_g$ 9, is connected to electrode 22 and may be adjusted to change the locations of the source focal point 81 to a different location 81A.

Ion Source

The focal lengths for first order velocity and space focusing, respectively, for the embodiment employing two-stage acceleration in the ion source as depicted in FIGS. 4 and 5 are give by $$D_s=2d_0y^{3/2}[1-(d_1/d_0)/(y^{1/2}+y)] \quad (4)$$

$$D_v=D_s+(2d_0y)^2/(v_n^*\Delta t) \quad (5)$$

where $d_0$ is the length of the first acceleration region $d_1$ is the length of the second acceleration region, Δt is the time lag between ion production and application of the accelerating field, $y=V/(V-V_g)$, and $v_n^*$ is the nominal final velocity of the ion of mass m* focused at $D_v$. $v_n^*$ is given by $$v_n^*=C_1(V/m^*)^{1/2} \quad (6)$$

The numerical constant $C_1$ is given by $$C_1=(2z_0/m_0)^{1/2}=2\times1.60219\times10^{-19}\ coul/1.66056\times10^{-27}\ kg=1.38914\times10^4 \quad (7)$$

For V in volts and m in Da (or m/z) the velocity of an ion is given by $$v=C_1(V/m)^{1/2}\ \text{m/sec} \quad (8)$$

It is numerically more convenient in many cases to express distances in mm and times in nanoseconds. In these cases $C_1=1.38914\times10^{-2}$, and v is in units of mm/nsec. The focal lengths of a single-field pulsed ion source as depicted in FIGS. 2 and 3 with time lag focusing are also given by equations (4) and (5) with y=1 and $d_1=0$.

Second order focusing for a two-stage source occurs at $$D_{s2}=2d_1(1-3/y)^{-1} \quad (9)$$

And for a single-stage source $$D_{s2}=6d_0 \quad (10)$$

The relative contribution to peak width due to variation δx in the initial position of the ions is given by $$R_{s1}=[(D_v-D_s)/D_e](\delta x/d_0y) \quad (11)$$

and $D_e$ is the total effective flight length of the ions. With delayed extraction the focal length of the source is mass dependent, and the contribution to peak width for ions other than the focused mass is given by $$R_m=R_{v1}[1-(m/m^*)^{1/2}] \quad (12)$$

Where $$R_{v1}=(4d_0y/D_e)(\delta v_0/v) \quad (13)$$

Where $\delta v_0$ is the width of the initial velocity distribution.

If $D_v=D_{s2}$ then the focus at $D_v$ is independent of initial velocity to both first and second order, and the contribution to peak width at the focused mass due to the initial velocity distribution is given by $$R_{v3}=2[2d_0y/(D_v-D_s)]^3(\delta v_0/v)^3 \tag{14}$$

Clearly the best resolving power is obtained by making $D_e$ as large as possible within the overall geometric constraints imposed by the overall size of the instrument. Addition of a reflector allows the effective length to be increased without increasing the other contributions to peak width.

Ion Reflector

First and second order velocity focusing in a reflector requires satisfying equations (1)-(3) as discussed above.

The time of flight through a two-stage reflecting analyzer with dissociation of the precursor ion $m_p$ to fragment $m_f$ in the first field-free drift space is given by $$t=(D/v)\{1+(4d_3/D)(m_f/m_p)(V/V_1)\{1+[(d_4/d_3)(V_1/[V-V_1])-1][1-(m_p/m_f)(V_1/V)]^{1/2}\} \tag{15}$$

$$t_1(m_p)=D/v \tag{16}$$

is the time spent in the field-free region between the focal point and the detector. The velocity of the ions in the field-free region, v, is given by $$v=(2zV/m_p)^{1/2} \tag{17}$$

and is essentially unchanged even though fragmentation occurs. After fragmentation the kinetic energy of the fragment ions is $V(m_f/m_p)$. If the potentials applied to the reflector are adjusted by an amount R so that $$R=V_1/V_1^0=m_f/m_p=V_2/V_2^0 \tag{18}$$

where $V_1^0$ and $V_2^0$ are the potentials applied for focusing unfragmented ions, then the flight time of a fragment ion $m_f$ is identical to that for the precursor ion $m_p$ with R=1.

The total flight time for a fragment ion $m_f$ formed by fragmentation of $m_p$ in the field-free region is $$t(m_f,m_p)=t_1(m_p)+t_m(m_f/Rm_p) \tag{19}$$

Where $$t_m(m_f/Rm_p)=(4d_3/v)(m_f/m_p)(V/RV_1^0)\{1+[(d_4^0/d_3)(V_1/[V_2-V_1])-1][1-(m_p/m_f)(RV_1^0/V)]^{1/2}\}\} \tag{20}$$

Define $$x=t_m(m_f/Rm_p)/(4d_3/V),z=(m_p/m_f)(RV_1^0/V),\epsilon=(d_4^0/d_3)(V_1/[V_2-V_1])-2 \tag{21}$$

Then equation (20) may be written as $$x=(1/z)[1+(1+\epsilon)(1-z)^{1/2}] \tag{22}$$

This is a quadratic equation that can be inverted by the following procedure $$(xz-1)^2=(1+\epsilon)^2(1-z) \tag{23}$$

$$x^2z^2-2xz+1=(1+\epsilon)^2-z(1+\epsilon)^2 \tag{24}$$

$$x^2z^2-z[2x-(1+\epsilon)^2]-[2\epsilon+\epsilon^2]=0 \tag{25}$$

Equation (25) can be inverted using the quadratic formula to give z as a function of x. The general solution is $$z=[2x-(1+\epsilon)^2]\{1+/-[1+4x^2(2\epsilon+\epsilon^2)/(2x-(1+\epsilon)^2))]^{1/2}\}/2x^2 \tag{26}$$

An important practical case corresponds to that where the field strength in the first stage of the mirror is three times that in the second stage and the effective length of the second stage $d_4$ is ⅔ that of the first stage $d_3$. In this case $\epsilon=0$, and $(V_1^0/V)$ is ¾. The non-zero root of (22) is then $$z=(1/x^2)[2x-1] \tag{27}$$

$$1/z=x^2/[2x-1]$$

$$m_f=(m_p/z)R(V_1^0/V)=m_p(3R/4)x^2/[2x-1] \tag{28}$$

If $\epsilon$ is not zero but small compared to unity, then to first order in $\epsilon$ the solution is $$z=(1/x^2)[2x-1+\epsilon(x-1)/2] \tag{29}$$

The value of x can be determined from the measurements of flight times as follows. When $m_f/Rm_p=1$, the time in the mirror is equal to the time for the precursor ion. Thus $$t(m_p)=t_1(m_p)+t_m(1) \tag{30}$$

and substituting into (12) with $\epsilon=0$, $V_1^0/V=3/4$ $$t_m(1)=2(4d_1/v) \tag{31}$$

thus x can be expressed in terms of measurable quantities as $$x=2[t(m_f,m_p)-t_1(m_p)]/[t(m_p)-t_1(m_p)] \tag{32}$$

Thus the fragment mass $m_f$ produced from any precursor mass $m_p$ can be determined using equation (29) using the value of x determined by the measurements of flight times for fragment and precursor masses. The ratio of flight time in the field-free region $t_1(m_p)$ to the total flight time $t(m_p)$ is independent of mass and can be determined by measuring flight times for precursor ions as a function of R. Alternatively, we can set $$q=x/2=[t(m_f,m_p)-t_1(m_p)]/[t(m_p)-t_1(m_p)] \tag{33}$$

and $$m_f=(m_p/z)R(V_1^0/V)=m_p(3Rq^2)/[4q-1] \tag{34}$$

Design of the Analyzer

Figure 6A:
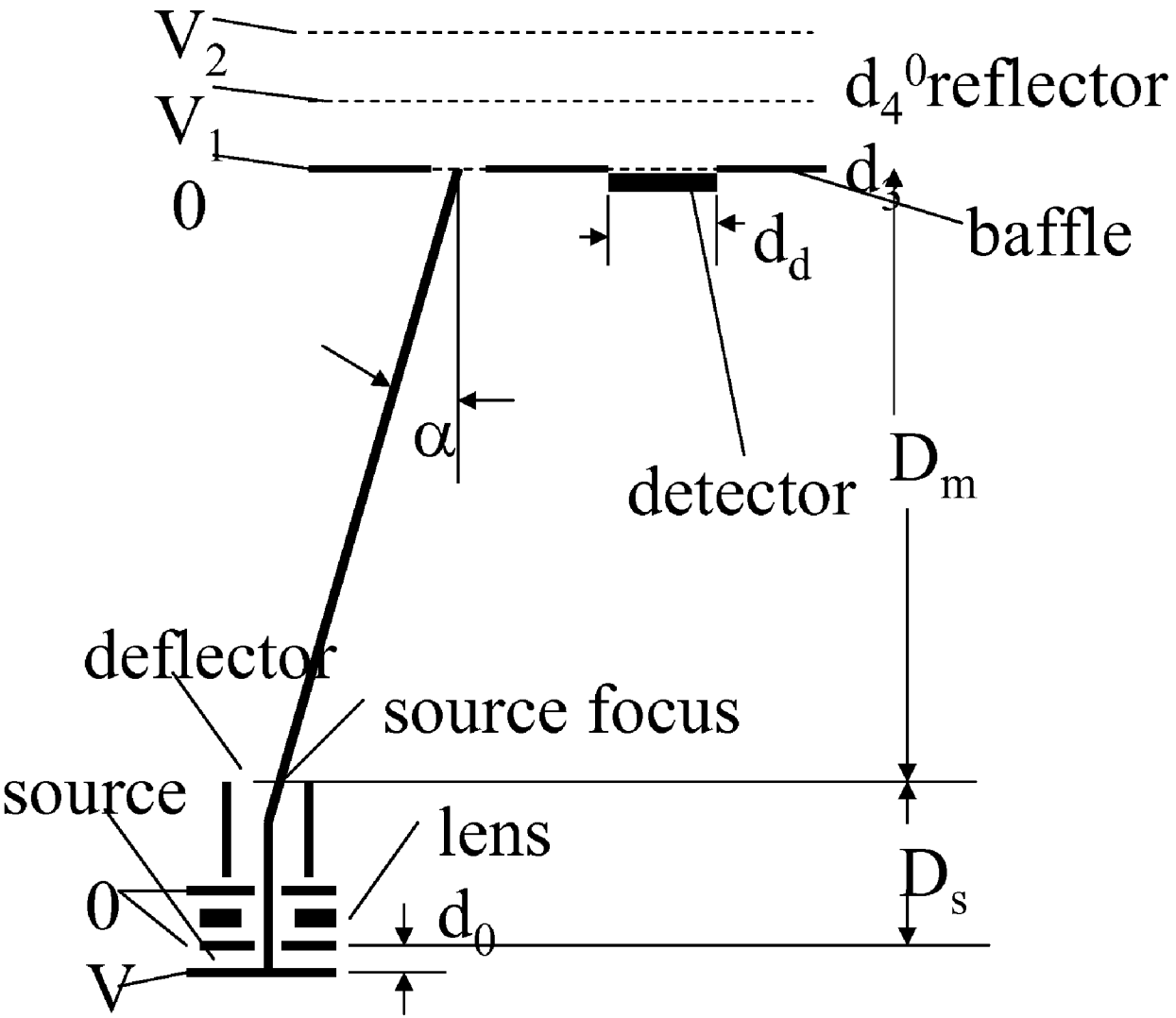
FIG. 6A illustrates dimensions and voltages for one embodiment of the invention.
Figure 6B:
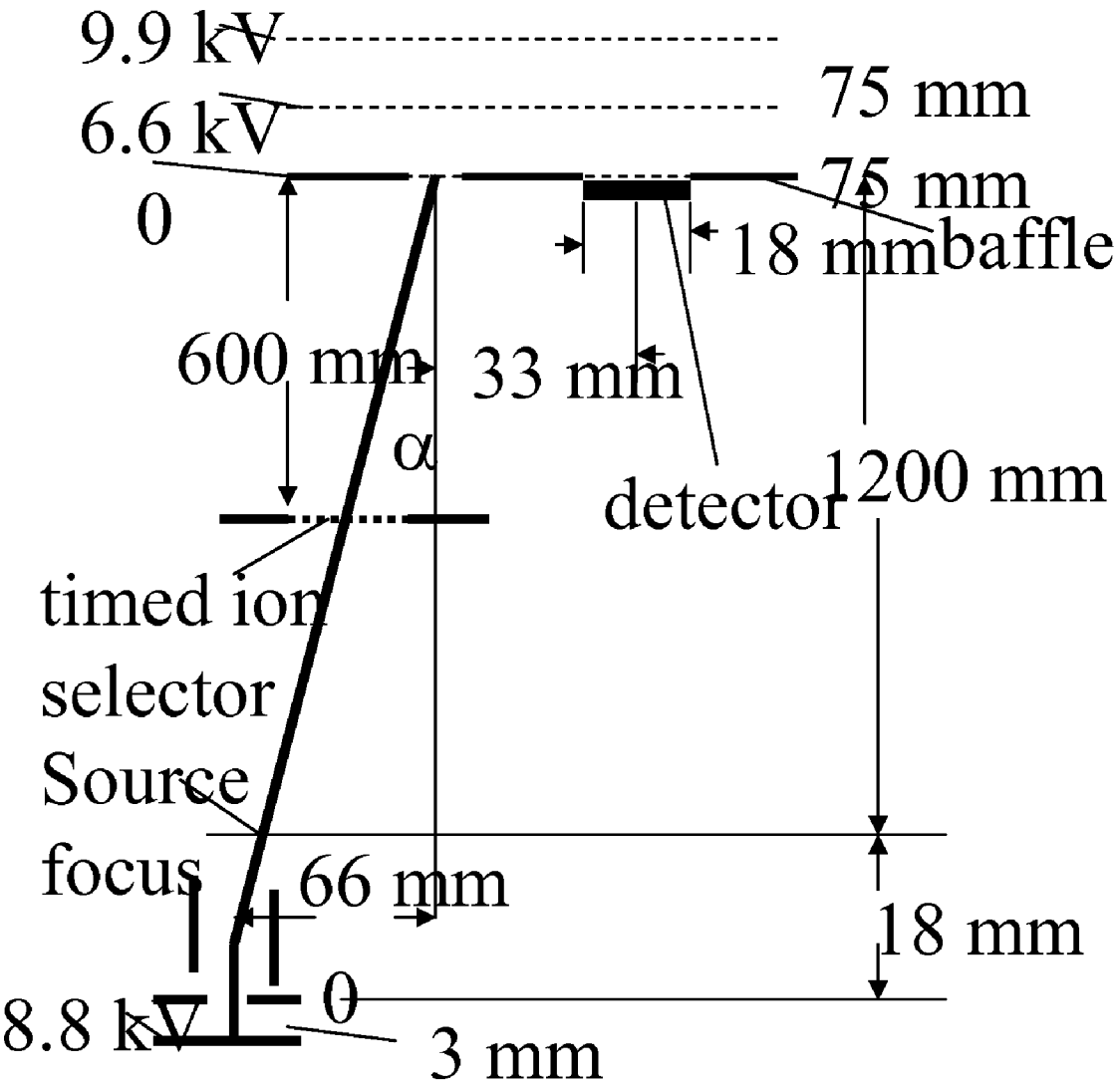
FIG. 6B illustrates dimensions and voltages for one embodiment of the invention.

One embodiment of the invention is illustrated in FIG. 6. The total field-free distance $D_m$ from the source focus $D_v$ to the detector is 1200 mm, $d_3=d_4^0=75$ mm, and tan $\alpha=1/18$. The nominal transverse distance between source and detector is 100 mm. The source voltage V is 8800 volts, $V_1=6600$ volts, and $V_2=9900$ volts. The nominal penetration of ions into the second field of the mirror is 50 mm. The timed ion selector is located midway between $D_v$ and the entrance to the mirror at 600 mm from $D_v$. A single field source is used with an accelerating field 3 mm long. The optimum location for $D_v$ is about 18 mm from the exit of the source; thus the total effective field-free length (including the source) is 1224 mm and the total effective length is nominally 1824 mm.

This geometry satisfies the conditions required for the simpler calibration equation (34) to apply. The nominal flight time through the field free region relative to the total is given by $$t_1(m_p)/t(m_p)=1224/1824=0.671=C \tag{35}$$

$$q=[t(m_f)/t(m_p)-0.671]/0.329=3.040[t(m_f)/t(m_p)]-2.040 \tag{36}$$

The calibration is not very sensitive to the value of the constant C; thus the default value may be adequate. The important parameter determining calibration accuracy is the mirror ratio R. If 16-bit DAC's are used for setting the voltages, then the accuracy is not better than about 15 ppm. Data from fragmentation of a known peptide, e.g. Glu 1-Fib, can be used to construct a calibration curve for actual value $R_a$ relative to set value $R_s$. If the actual value of R is equal to $m_f/m_p$, then $t(m_f)/t(m_p)=1$, and any observed deviation can be used to determine the true value of R. This can then be used to construct a calibration curve $$R_a=aR_s+b \tag{37}$$

By a least-squares fit between the actual and observed values.

$$R_a=[3.040t(m_f)/t(m_p)-2.040]R_s \tag{38}$$

where $R_s$ is nominally set equal to $m_f/m_p$.

Figure 7:
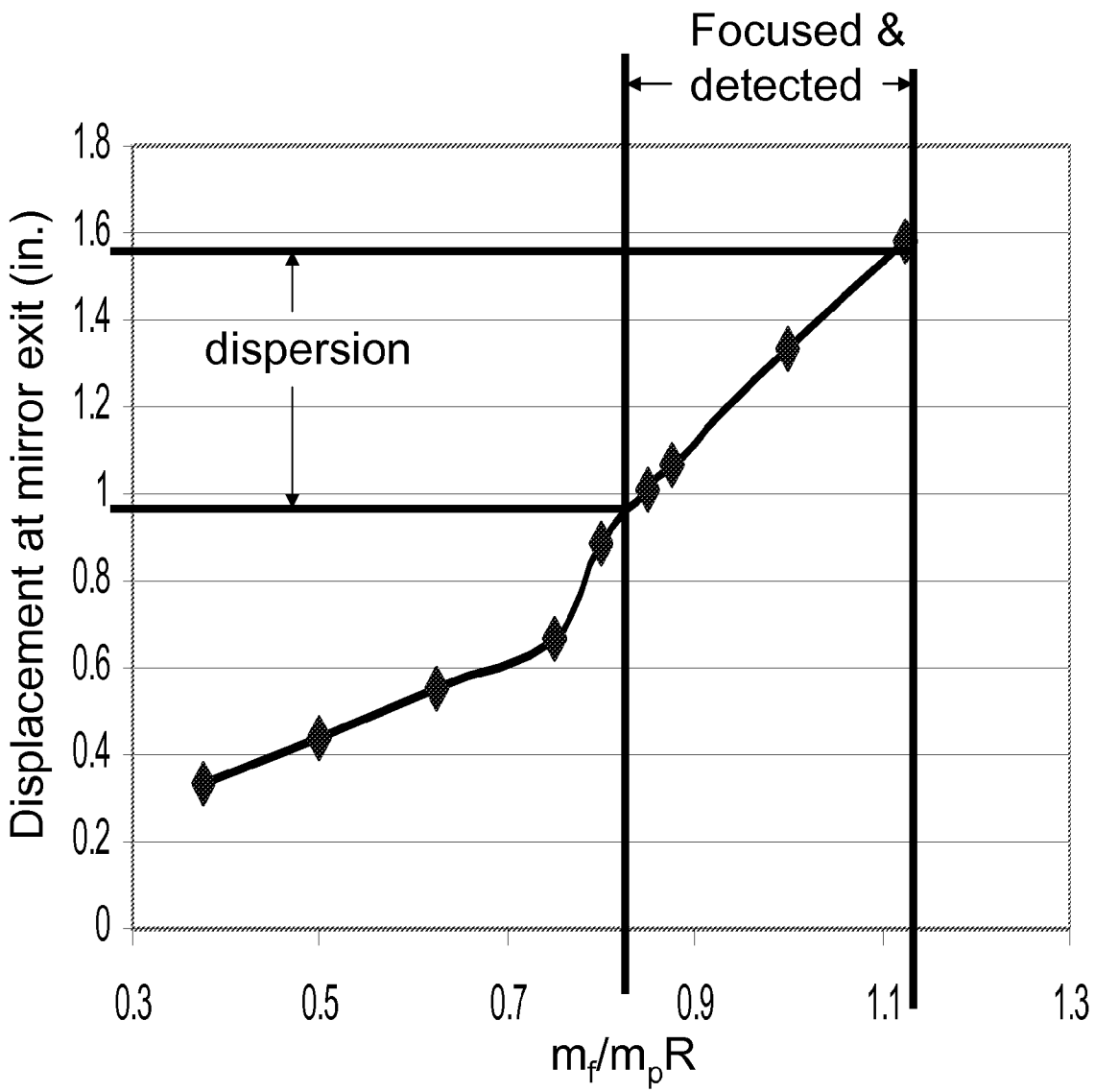
FIG. 7 is a graph showing calculation of displacement of ion trajectories at the exit from the mirror as function of $m_f/m_pR$, for the embodiment depicted in FIG. 6B.

With the proposed geometry, ions with ratios $m_f/m_p$ between 0.85 and 1.12 R are focused and transmitted to the detector. Those with higher ratios exit through the back of the mirror. Ions corresponding to lower ratios are rejected by a baffle adjacent to the mirror exit. The displacement of ions as a function of $m_f/m_pR$ is shown in FIG. 7. Fragment ions from a given precursor arrive at the detector in a time range between 0.94 and 1.06 times the flight time for the precursor. Thus precursor selection can be multiplexed, and so long as the selected masses differ by a factor of about 1.25 there is no overlap between fragment spectra. Masses differing by smaller amounts can be selected, but this will require deconvolution of overlapping spectra. Up to 100 precursors in the range 500-5000 Da can be analyzed simultaneously.

Depending on the coverage of the low mass portion of the fragment spectra required by the application, approximately 10 or fewer segments corresponding to different values of R are required to generate a complete spectrum, and at least 5 fold multiplexing can be done in most cases. Thus, the speed of this system operating at 5 khz is at least an order of magnitude faster than a conventional TOF-TOF operating at 200 hz. Furthermore, the sensitivity may be much higher, particularly for high-mass precursors, since there are no critical apertures or focusing required. The manufacturing cost is less than half that of commercial TOF-TOF instruments and it fits in a small bench-top cabinet less than 1500 mm in height.

Calibration

The precursor mass calibration employs the same algorithms used previously for calibrating reflector spectra, and the scale for R can be corrected and calibrated using known fragment spectra. Default values of the other parameters may be sufficiently accurate, but these can be independently determined using known precursor masses and observing the shifts in flight time produced by varying R about the nominal value of R=1. The flight time of a precursor ion for a given value of R can be expressed as $$t(m,R)=C_1[1+(4/3R)C_2\{1+(1-3R/4)^{1/2}\}]=C_1[1+C_2f(R)] \tag{39}$$

$$t(m,1)=C_1[1+2C_2] \tag{40}$$

$$f(R)=(4/3R)\{1+(1-3R/4)^{1/2}\} \tag{41}$$

Solving for $C_1$ and $C_2$ gives $$C_2=[1-t(m,R)/t(m,1)]/\{[(2t(m,R)/t(m,1)]-f(R)\} \tag{42}$$

$$C_1=t(m,1)/[1+2C_2] \tag{43}$$

These should be independent of the mass used for determination as well as the value of R, and may be compared with the default values for the geometry described above where $$C_1=(D/v)=t_1(m) \text{ and } C_2=(4d_1/D)=0.245 \tag{44}$$

The coefficient C required in the calibration is given by $$C=t_1(m)/t(m,1)=1/(1+2C_2)=0.671 \text{ for the default value of } C_2 \tag{45}$$

Deviations in the apparent value of $C_2$ determined at different values of R may indicate either that the value of $V_1/V$ is not exactly 0.75 or that the ratio of the field in the first region of the mirror is not exactly equal to twice that in the second region. In this case the data may be fit to equation (30) to determine the actual value of $\epsilon$. Calibration of the voltages $V_1$ and $V_2$ may be required to remove any apparent dependence on R.

Calculation of Resolving Power and Mass Accuracy for MS and MS-MS

The contribution to peak width due to the uncertainty $\delta t$ in the time measurement is given by $$R_t=2v\delta t/D_e \tag{46}$$

The other important contributions to peak width for precursor ions are given in equations (11) to (14) above. For fragment ions the resolving power is somewhat lower for ions detected where $Rm_p/m_f$ is not equal to one. These ions travel a longer or shorter time in the mirror that that required for the optimum time focus, so their focus occurs at a distance from the detector. The additional peak width due to this effect is given by $$R_R=\Delta m/m=2\Delta d_f/D_e=2\Delta t_R(\Delta v)/D_e \tag{47}$$

where $D_e$ is the effective total flight distance, $\Delta v$ is the velocity spread introduced by time lag focusing, and $\Delta t_R$ is the difference in time for a fragment ion for a particular value of $m_f/m_p$ compared to one where $m_f/m_pR=1$. Thus $$\Delta v=(v_0\Delta t/2d_s)v=[(2d_s/(D_s-2d_a)]\delta v_0=(1/2)\delta v_0 \tag{48}$$

$$\Delta t_R=t(m_f/m_pR)-t(1) \tag{49}$$

$$D_e=t(1)v \tag{50}$$

Thus $$R_R=\Delta m/m=\{[t(m_f/m_pR)/t(1)]-1\}(\delta v_0/v) \tag{51}$$

Figure 8:
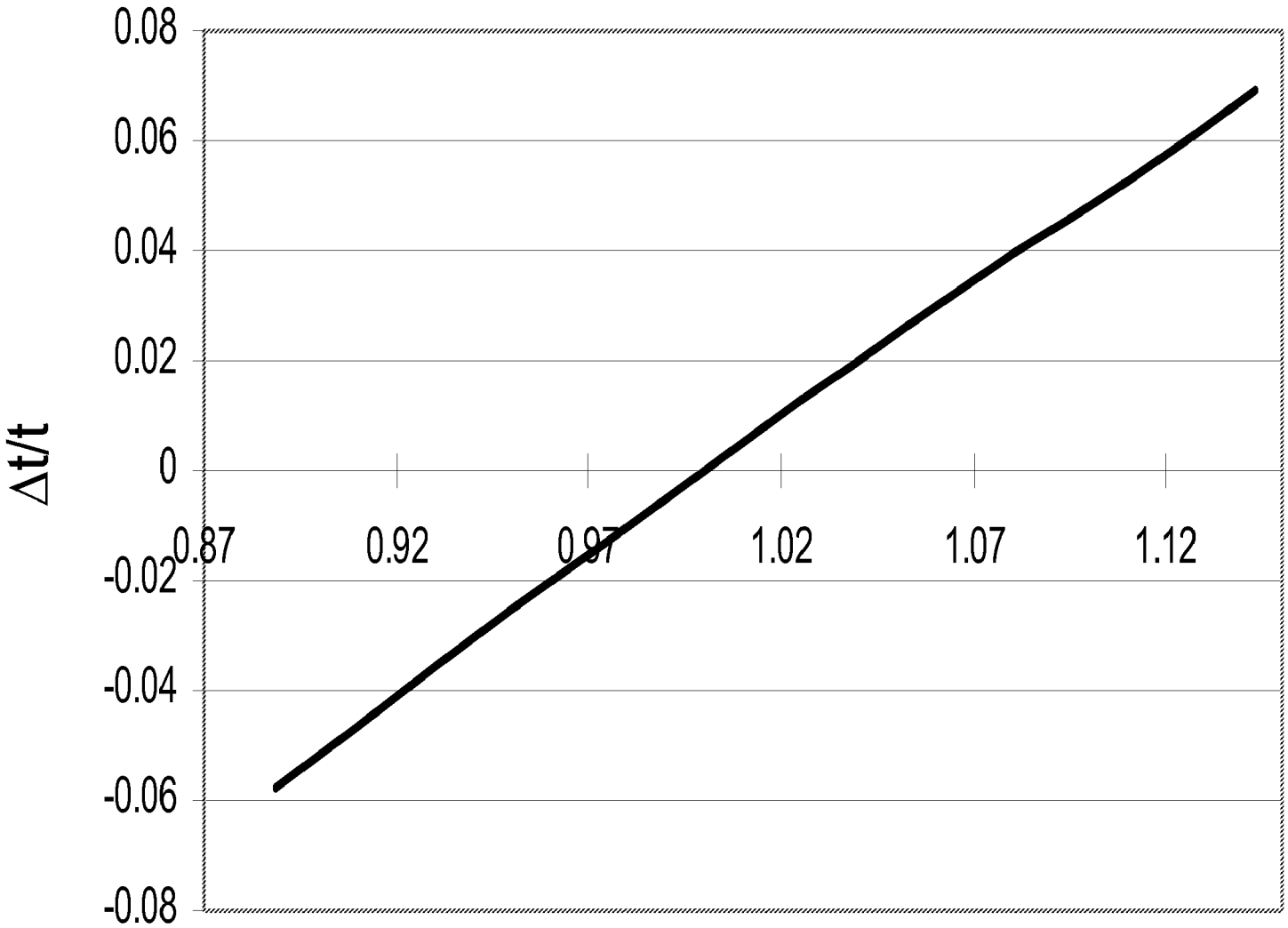
FIG. 8 is a graph showing the change is total flight time of fragment ions relative to precursor as function of $m_f/m_pR$ for the embodiment depicted in FIG. 6B.

The quantity in the { } brackets is plotted as a function of $m_v/m_pR$ in FIG. 8. Over the range of focus employed the value at the extremes is about 0.07.

For any geometry such as that depicted in FIG. 6, these equations can be used to estimate the resolving power for any set of initial conditions and operating parameters. Typical values for the initial conditions are $$\delta v_0=400 \text{ m/s}=4\times10^{-4} \text{ mm/nsec}, \delta x=0.01 \text{ mm}. \tag{52}$$

The ratio $\delta v_0/v$ for 8.8 kV ions is approximately 0.01 $m^{1/2}$ for m in kDa. Thus for the geometry illustrated in FIG. 6

$$R_{s1}=4(0.01)/1824=2.2\times10^{-5}\ R_{s1}^{-1}=45{,}600$$

$$R_{v1}=[4(3)/1824](0.01\ m^{1/2})=6.56\times10^{-5}\ m^{1/2}\ R_{v1}^{-1}=15{,}200\ m^{-1/2}$$

$$R_{v3}=(0.01\ m^{1/2})^3=10^{-6}\ m^{3/2}\ R_{v3}^{-1}=1{,}000{,}000\ m^{-3/2}$$

$$R_t=m^{-1/2}/[2(1.5)(0.041)]/1824=6.78\times10^{-5}\ m^{-1/2}\ R_t^{-1}=14{,}700\ m^{1/2}$$

$$R_R(\max)=(0.07)(0.01\ m^{1/2})=7\times10^{-4}\ m^{1/2}\ R_R^{-1}(\min)=1{,}430\ m^{-1/2}$$

In all cases the mass is that of the precursor. The time resolution $R_t$ is calculated using a minimum peak width of 1.5 nsec; this is consistent with experimental results employing 0.5 nsec digitizer bins and 5 um channel plates. This clearly is the major limitation of resolving power for the precursor spectra at low mass, and could be improved by using a faster detector and narrower bin widths.

Since each of these contributions to peak width are essentially independent, the overall peak width can be estimated by taking the square root of the sum of the squares of the individual concentration. The contribution to peak width due to energy imparted in the fragmentation process has not been taken into account in this analysis. This may make a significant contribution to peak widths for low mass fragments.

Calculated resolving powers are summarized below in Table 1 for the source delay optimized for m/z 3 kda.

TABLE 1

| | Resolving power | | | |
|---|---|---|---|---|
| | | | Fragment | |
| | Precursor MS | | Max. | Min. |
| m/z (kDa) | $R_t^{-1}$ | $R_v^{-1}$ | $R^{-1}$ | $R^{-1}$ |
| 0.5 | 10,400 | 14,840 | 8370 | 5800 |
| 1 | 14,700 | 20,800 | 11,610 | 5120 |
| 2 | 20,800 | 47,800 | 17,600 | 3930 |
| 3 | 25,460 | 192,000 | 22,070 | 3250 |
| 4 | 29,400 | 56,700 | 22,650 | 2830 |
| 5 | 32,870 | 30,150 | 19,970 | 2530 |
| 6 | 36,000 | 21,190 | 16,950 | 2300 |
| 10 | 46,500 | 10,600 | 9,840 | 1770 |

Figure 9:
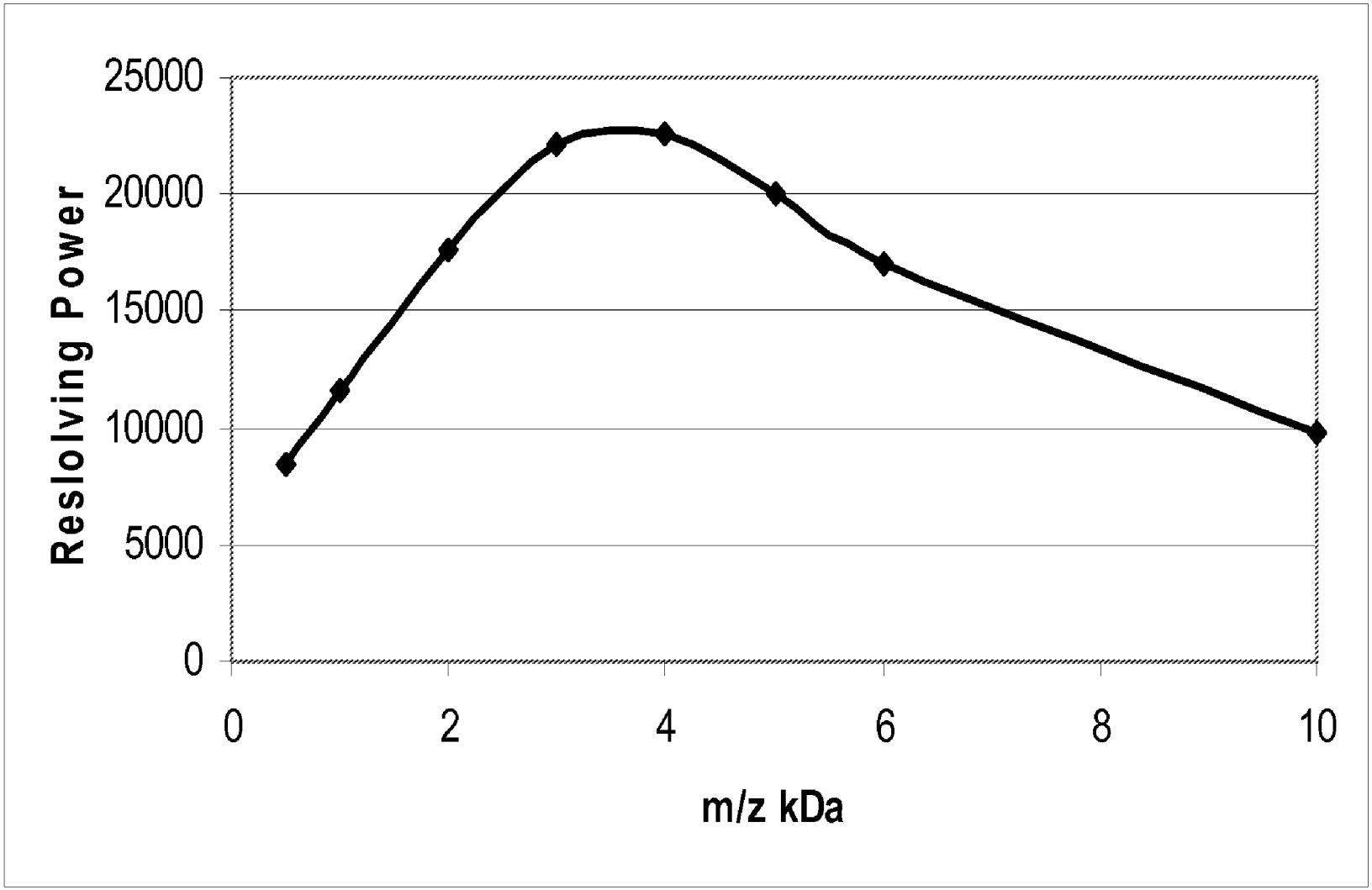
FIG. 9 is a graph of the calculated resolving power as a function of precursor mass in MS mode with source focused at 3 kDa for the embodiment depicted in FIG. 6B.

Source delay is focused for 3 kda. Calculated resolving power as function of precursor mass is shown in FIG. 9. Fragment resolving power varies with $m_f/m_pR$ from maximum equal to the precursor resolving power at $m_f/m_pR=1$, is shown in Table 2. Resolving Power as a function of $m_f/m_pR$ over the range of focus of the mirror for precursor masses between 0.5 and 10 kDa is shown. Isotopic resolution is achieved over the entire range for precursors less than 2 kda, and over most of the range up to 4 kda.

TABLE 2

| | Resolving Power as a function of fragment mass | | | | | | | | |
|---|---|---|---|---|---|---|---|---|---|
| | mf/mpR-1 | | | | | | | | |
| Mass | 0 | 0.01 | 0.02 | 0.03 | 0.04 | 0.05 | 0.06 | 0.07 | 0.08 |
| 0.5 | 5630 | 5590 | 5470 | 5290 | 5070 | 4815 | 4555 | 4300 | 4040 |
| 1 | 7720 | 7515 | 6990 | 6300 | 5630 | 5000 | 4470 | 4010 | 3630 |
| 2 | 14330 | 12200 | 9030 | 6820 | 5390 | 4420 | 3740 | 3240 | 2850 |
| 3 | 22240 | 14440 | 8730 | 6090 | 4640 | 3740 | 3130 | 2690 | 2360 |
| 4 | 17230 | 11900 | 7420 | 5225 | 4000 | 3230 | 2710 | 2330 | 2040 |
| 5 | 10940 | 8780 | 6100 | 4475 | 3490 | 2840 | 2390 | 2060 | 1810 |
| 6 | 8170 | 6980 | 5190 | 3925 | 3105 | 2550 | 2160 | 1870 | 1640 |
| 10 | 4290 | 3965 | 3310 | 2700 | 2220 | 1870 | 1610 | 1400 | 1245 |

Operating Protocol

The system operates in both MS and MS-MS modes. In MS mode the laser is set at a relatively low level appropriate for obtaining high-resolution spectra. The mirror voltages are set to the nominal values as shown in FIG. 1, and MS spectra are recorded for all of the sample spots in a set of samples. This could be a single spot, all of the spots generated by an LC run, or all of the spots on the plate. In some cases the set of samples could include multiple plates that can be loaded using the automated plate loader, but this would be the exception rather than the rule.

Normally each sample spot will include a known component used to internally calibrate the spectrum, providing routine mass errors less than 1 ppm RMS. The raw time-of-flight spectra are processed to produce mono-isotopic peak tables including integrated intensity (expressed as ions/laser shot integrated over the isotopic envelope), centroid mass, and peak width as Δm/m (FWHM) for each spot. These peak tables are then analyzed to produce as set of mono-isotopic masses that require MS-MS spectra to be measured. Some may be excluded by criteria established in a peak exclusion list. Some examples of peaks that might be excluded are listed below:

1) The identity of the peptide is known by accurate mass and chromatographic retention time. (and the MS-MS spectrum is not needed for internal calibration).
2) The intensity is less than in a neighboring spot and the MS-MS spectrum will be acquired on the spot with maximum intensity.
3) The user may elect to exclude certain peaks for any reason.

In many cases MS-MS spectra for all of the peaks can be acquired in a single acquisition. In others, particularly those containing a large number of peaks of varying intensity in a particular region of the spectrum, may require two or more acquisitions to obtain satisfactory MS-MS spectra on all of the peaks.

Figure 10A:
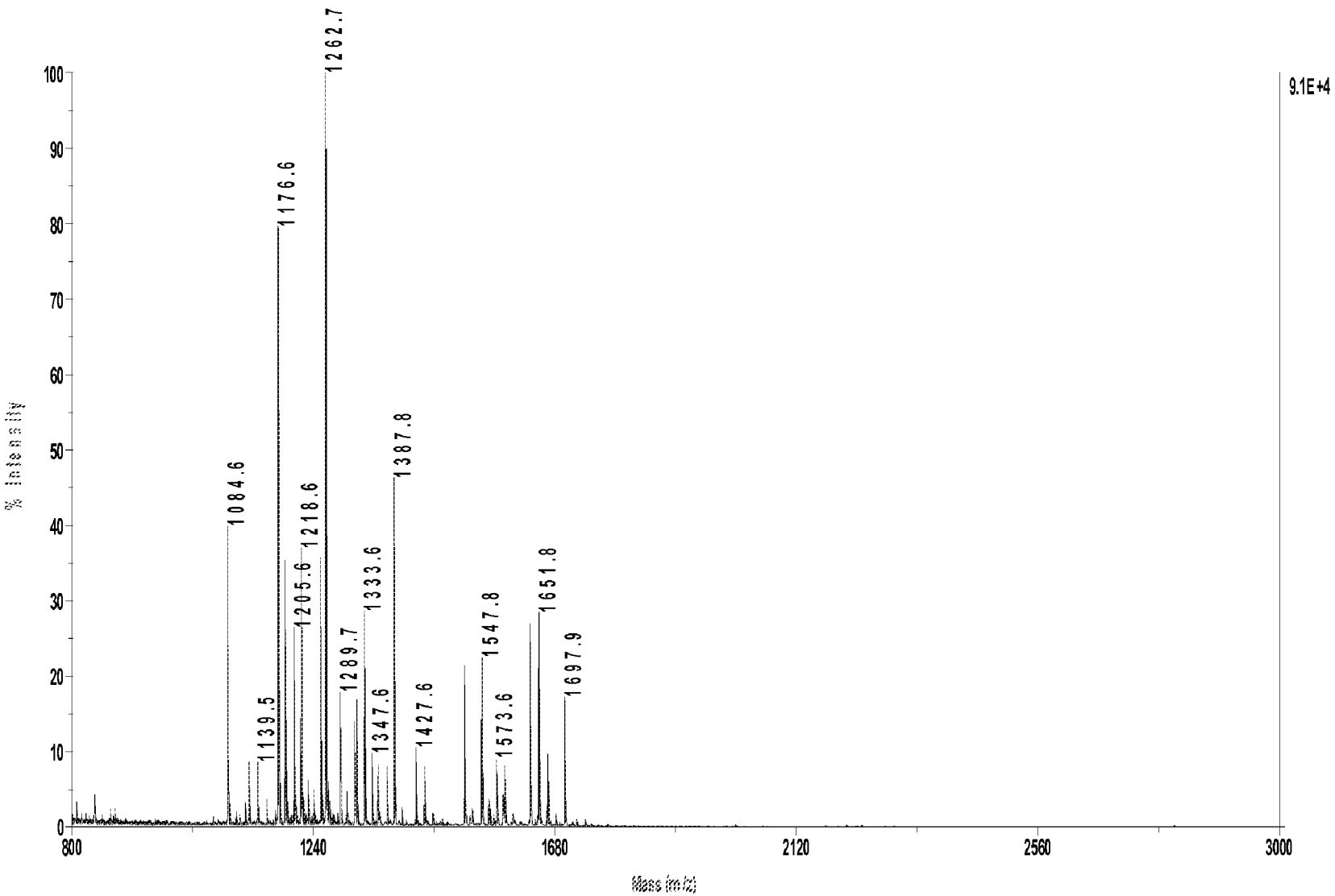
FIGS. 10A and 10B illustrate peptide mass fingerprints from tryptic digests of two recombinant proteins.
Figure 10B:
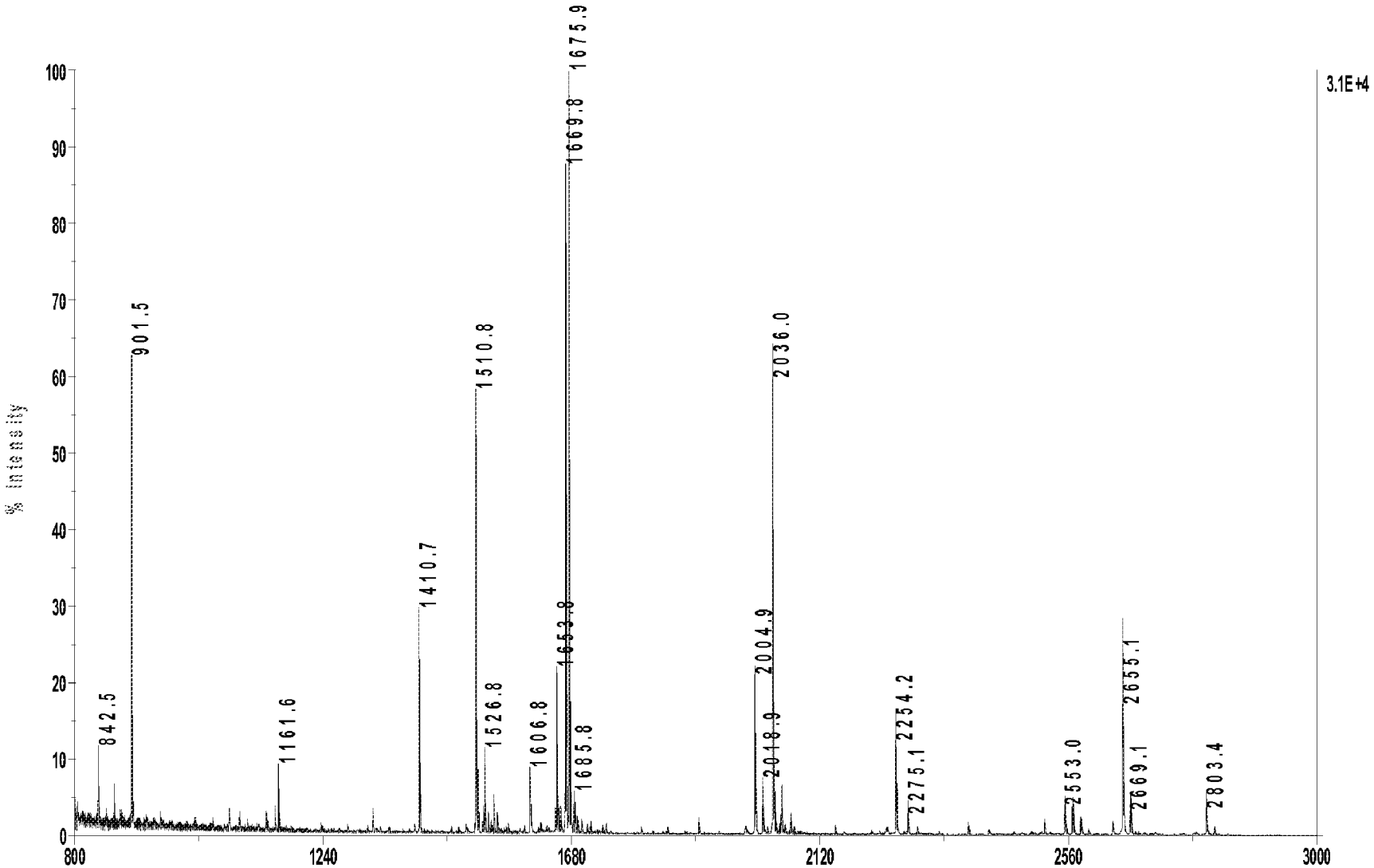

Two examples of peptides from tryptic digests of relatively pure proteins are shown in FIG. 10. The first example, 10A, has 31 peaks of significant intensity between m/z 1084 and 1700, while the second, 10B, has 26 peaks spread between 842 and 2800. In the latter case it should be practical to acquire MS-MS spectra from all 26 peaks in a single acquisition since the overlap between fragment spectra is modest. In the first case it may be necessary to employ two or more acquisitions. For example, the ten most intense peaks might be selected in the first run, and these peaks excluded in the second run. In both cases the timed-ion-selector must be programmed automatically based on the mono-isotopic mass list after any exclusions. In selecting a peak the timed-ion-selector is normally set to transmit the entire isotopic envelope corresponding to that peak. If more than one mono-isotopic peak is located within that range, then both are transmitted and included in the subsequent analysis. In cases where selected peaks are closer than ca. 2% in mass then generally the selector is set to transmit all peaks within the range defined by these peaks. For example, in case II, the timed-ion-selector may be set to transmit 842, 901, 1161, 1410, 1514-1526, 1606, 1653-1685, 2004-2051, 2254-2275, 2553-2582, 2655-2669, 2803. All ions including chemical noise outside these ranges are rejected. For case I a first analysis might include 1084, 1176-1190, 1253-1262, 1387, 1515, 1634-1651, and 1697. In the second analysis these regions along with masses below 1123 and above 1607 are excluded.

Acquisition of MS-MS Spectra

A file of switching times for the timed-ion-selector is generated for each sample spot based on the above automated analysis of the MS spectra for each spot. Since the time required for downloading switching times is expected to be fast compared to settling times for voltages changes to the mirror, normally spectra from all of the sample spots in a set will be acquired for each value of R corresponding to mirror voltages. The first segment acquired, with the timed-ion-selector on, is with R=1 and with the laser at the intensity used for MS-MS and the multiplier gain adjusted so that precursor peaks are not in saturation. The flight time for all mono-isotopic precursor masses detected are recorded for use in the subsequent analysis of fragment spectra. These times are expected to be accurate for subsequent since they are recorded using the same laser intensity as the fragment spectra. The precursor masses determined in the original MS run will be to internally calibrate the mass scale.

The multiplier voltage is increased as required and mirror voltages are then set to the first value of R. The TOF spectrum is acquired and the data converted to peak tables consisting of ion intensity (ions/laser shot), centroid (in time) and peak width. The peak tables for each spot are added to that generated from the previous value of R for that spot and the raw data discarded. The mirror is then set to the next value of R and the process repeated until the complete set of spectra has been generated. Processing of the time spectra to produce fragment masses corresponding to each of the precursor will be carried out on acquired spectra at the same time that new spectra are being acquired. An example of a set of R values and maximum and minimum relative fragment masses are summarized below in Table 3. Except in cases where the low mass fragment are of particular interest, the first 10 segments are sufficient. In many cases, only 3 or 4 segments may be required to unambiguously identify the peptides.

TABLE 3

| R values for max/min fragment masses | | |
|---|---|---|
| | $m_f/m_p$ | |
| R | Min. | Max |
| .875 | .744 | .984 |
| .664 | .565 | .747 |
| .504 | .428 | .567 |
| .383 | .326 | .431 |
| .291 | .248 | .327 |
| .221 | .188 | .249 |
| .168 | .143 | .189 |
| .128 | .109 | .144 |
| .098 | .083 | .110 |
| .074 | .063 | .083 |
| .056 | .048 | .063 |
| .043 | .038 | .048 |
| .034 | .031 | .038 |
| .028 | .024 | .031 |
| .0215 | .019 | .024 |

Figure 11:
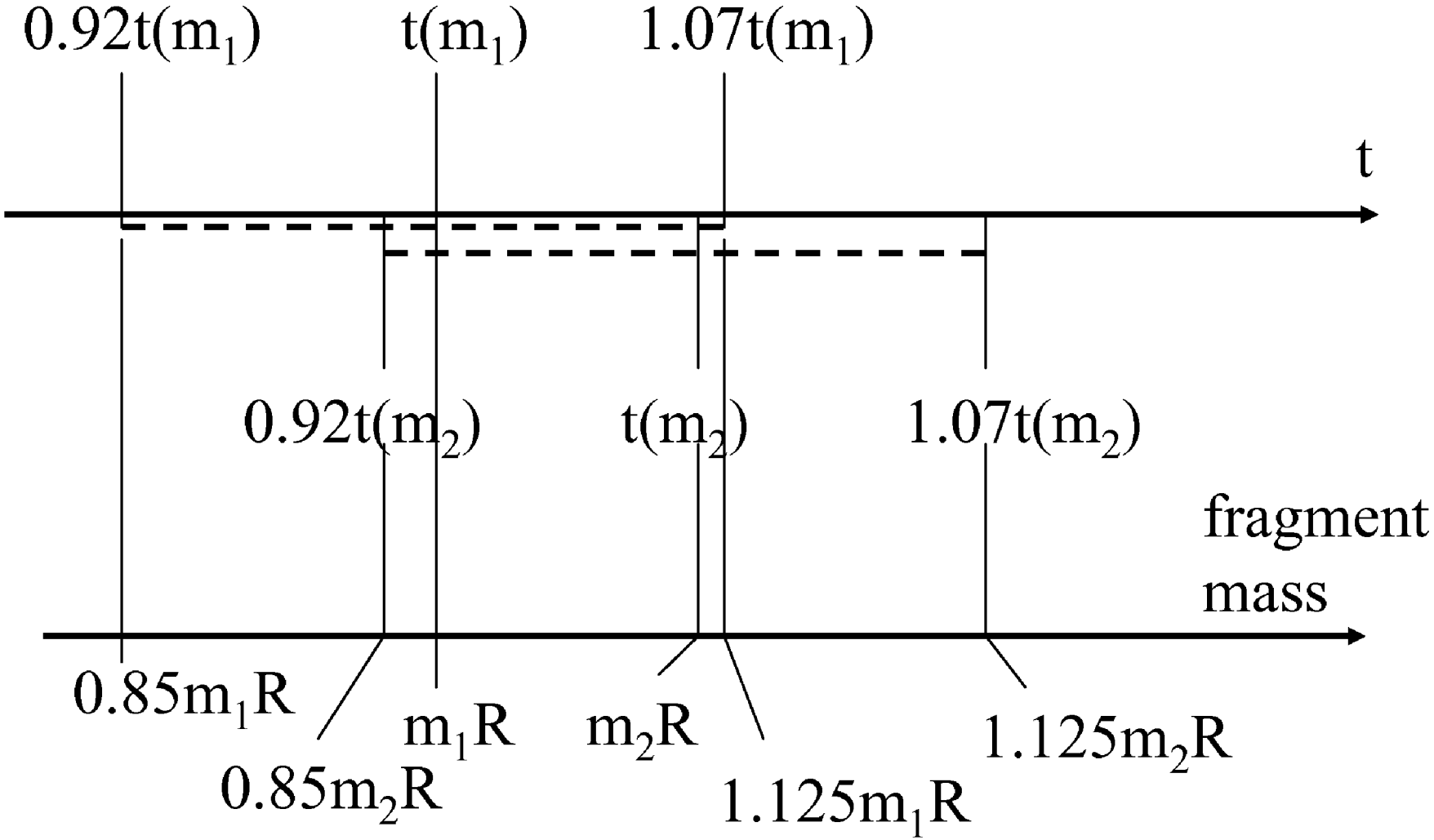
FIG. 11 is a schematic of a portion of the TOF spectrum for fragments from two precursors $m_1$ and $m_2$ where $m_2/m_1$ is less than 1.3.

If the masses selected differ by less than a factor of about 1.3, then the fragments from multiple precursors may occur within the same time range in the fragment TOF spectrum. This is illustrated schematically in FIG. 11. The dashed lines indicate the portion of the TOF spectrum where fragments of each precursor may occur, and in the region of overlap the assignment of the peaks to one or other precursor is made on the basis of the following criteria:

1. The apparent mass defect of the fragment ion is within the range expected for fragments of a given precursor.
2. The width of the peak is within the range predicted for a fragment produced with the computed value of $m_f/m_pR$. Expected peak widths can be predicted as indicated in Table II.
3. The intensity is within the expected range for a fragment of the given precursor. Intensities (expressed in ions/laser shot) are generally less than ca. 10% of total precursor intensity; thus a large peak is not a fragment of a weak precursor.

Figure 12:
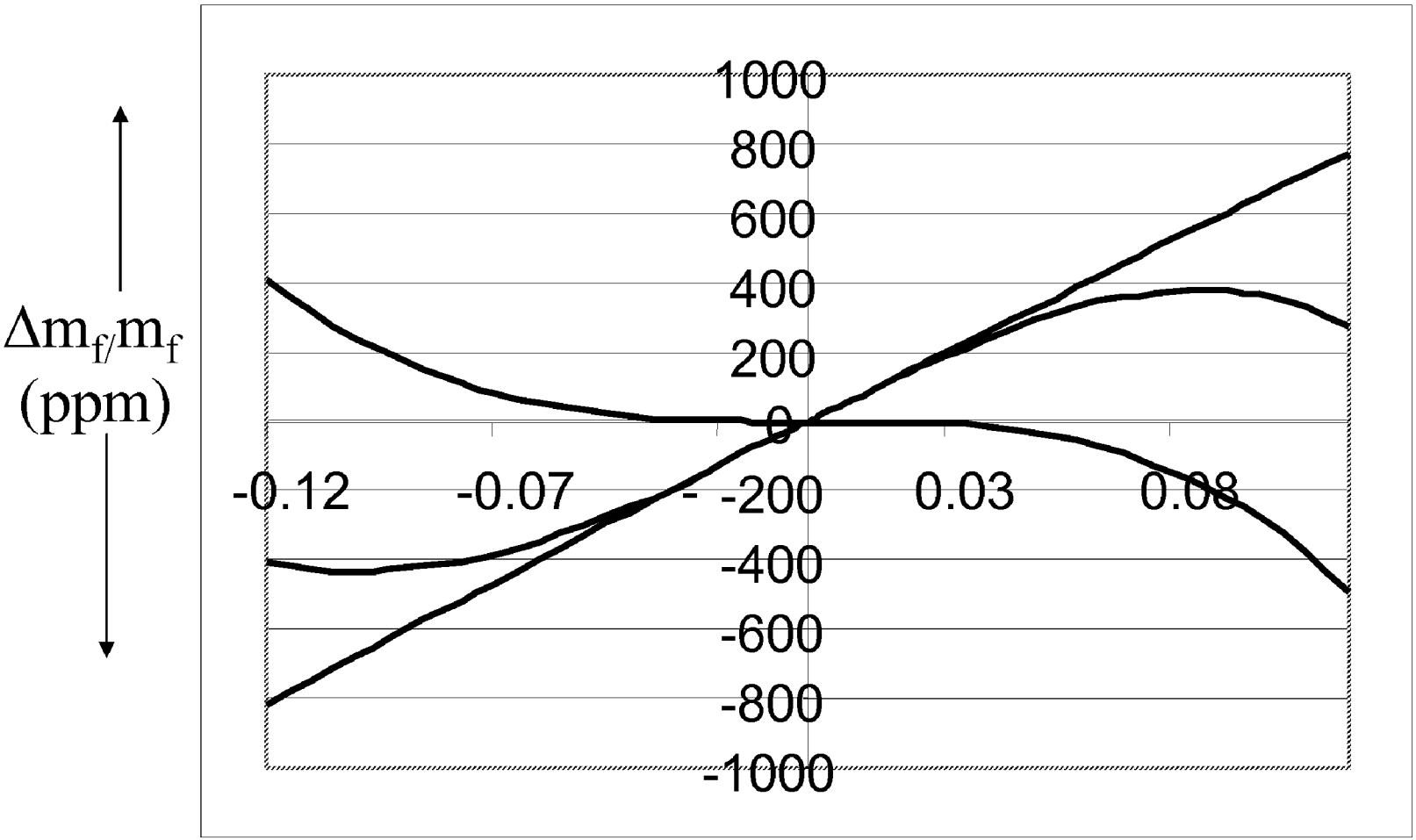
FIG. 12 is a graph illustrating the variation in apparent mass defect (relative to the correct value) as a function of presumed precursor mass relative to the correct precursor mass for source effective length of 24 mm.

The fragment TOF spectra will generally be internally calibrated using a known component in the mixture providing centroids of peaks in the time spectrum with error on the order of 1 ppm RMS. The natural variation of mass defect in a specific class of compounds, such as peptides, is on the order of +/−100 ppm. Thus in the first pass a given peak may be assigned to more than one precursor. However, in database searching where a peptide structure is proposed, a much tighter window (ca. +/−10 ppm) can be used since the exact mass for a proposed fragment is accurately known. Thus all fragments with apparent mass within the first window will be included in the fragment spectra for each of the precursors satisfying the criteria. The variation in apparent mass defect for a particular fragment mass as a function of the relative mass of an assumed precursor is shown in FIG. 12.

Figure 13:
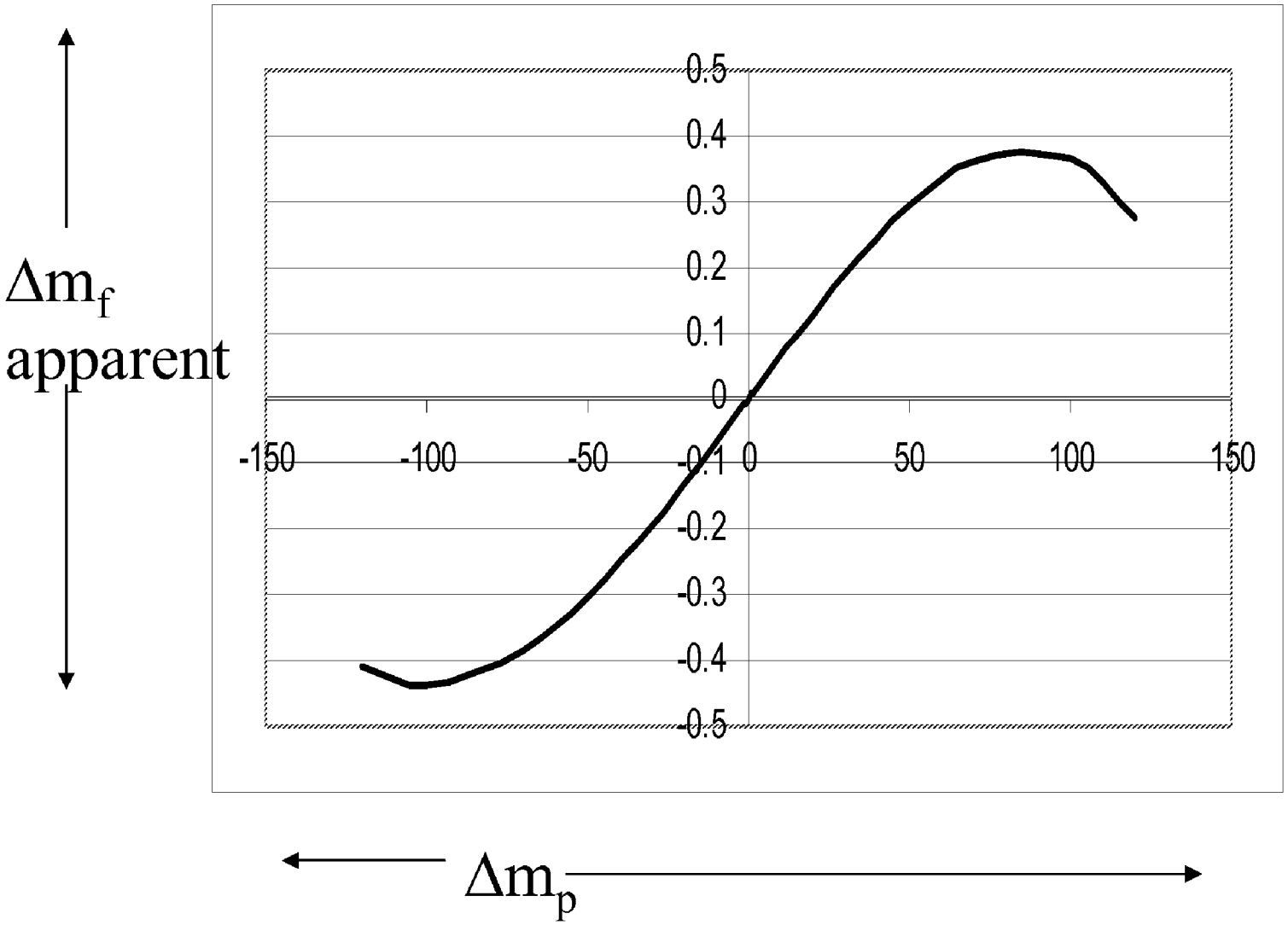
FIG. 13 is a graph of the apparent change in fragment mass as a function of change in precursor mass calculated for $m_{p0}$=1000, R=0.5 and $m_f$=500 for effective source length 24 mm.

The equation for the flight time of a fragment mass $m_f$ from a precursor $m_p$ can be written as $$t(m_f,m_p)=A(1+\alpha)^{1/2}\{(D_s/D_e)+(D/D_e)[1+(1/3)(1+\beta)/(1+\alpha)][1+[1-(1+\alpha)/(1+\beta)(3/4)]^{1/2}]\}A=D_e(m_{p0}/2zV)^{1/2} \quad (53)$$

where $m_p=m_{p0}(1+\alpha)$ and $m_f/m_{p0}R=1+\beta$, and the constants are for the geometry defined in FIG. 6, and where $\beta$ is between −0.15 and 0.125. The quantity in the outer square brackets multiplied by $D/D_e$ is the relative contribution due to the mirror and the drift space between the mirror and the mirror time focus, and the term $D_s/D_e$ is the relative contribution due to the ion source and the drift space between the ion source and the mirror (and source) time focus. The total effective flight distance is $D_s+1.5$ D for the geometry employed here. The mirror contribution for a given $m_f$ is independent of the precursor mass (to first and second order) due to the focusing properties of the two-stage mirror, but almost directly proportional to the precursor mass. On the other hand, the source contribution is proportional to the square root of the precursor mass, but independent of fragment mass. These contributions for $\beta=0$ are shown in FIG. 12 as a function of $\alpha$. This allows the error in apparent fragment mass to be computed as a function of precursor mass for any case of interest as illustrated in FIG. 13. If the precursor mass differs from the true value by more than about 1%, then the apparent mass of the fragment fall outside the window of possible mass defects. This allows unambiguous assignment of the correct precursor mass in these cases.

The apparent error in fragment mass due to an error in precursor mass can be magnified by increasing the focal length of the source.

Figure 14:
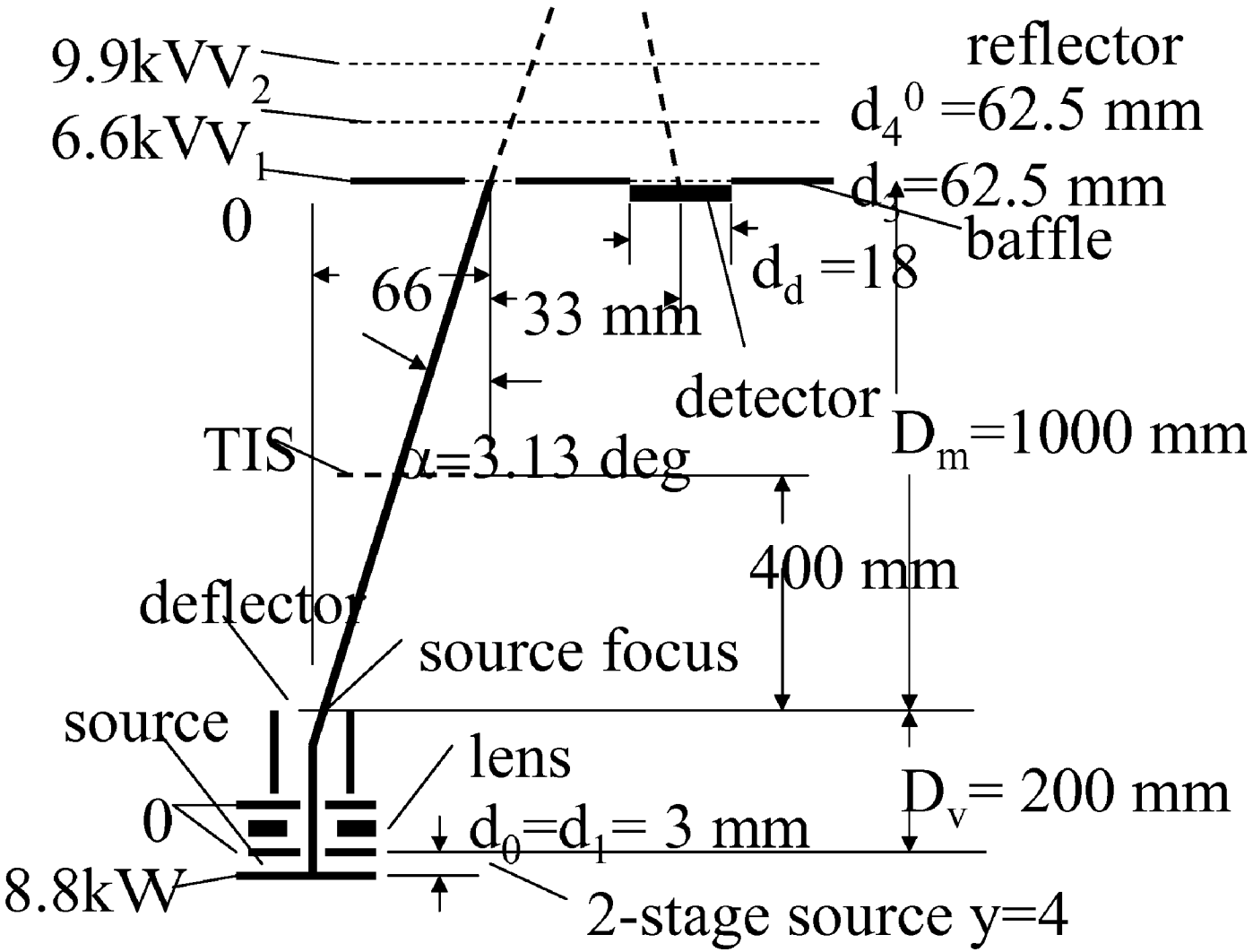
FIG. 14 is a schematic of an alternative embodiment with two-stage ion source and source effective length of 200 mm.
Figure 15:
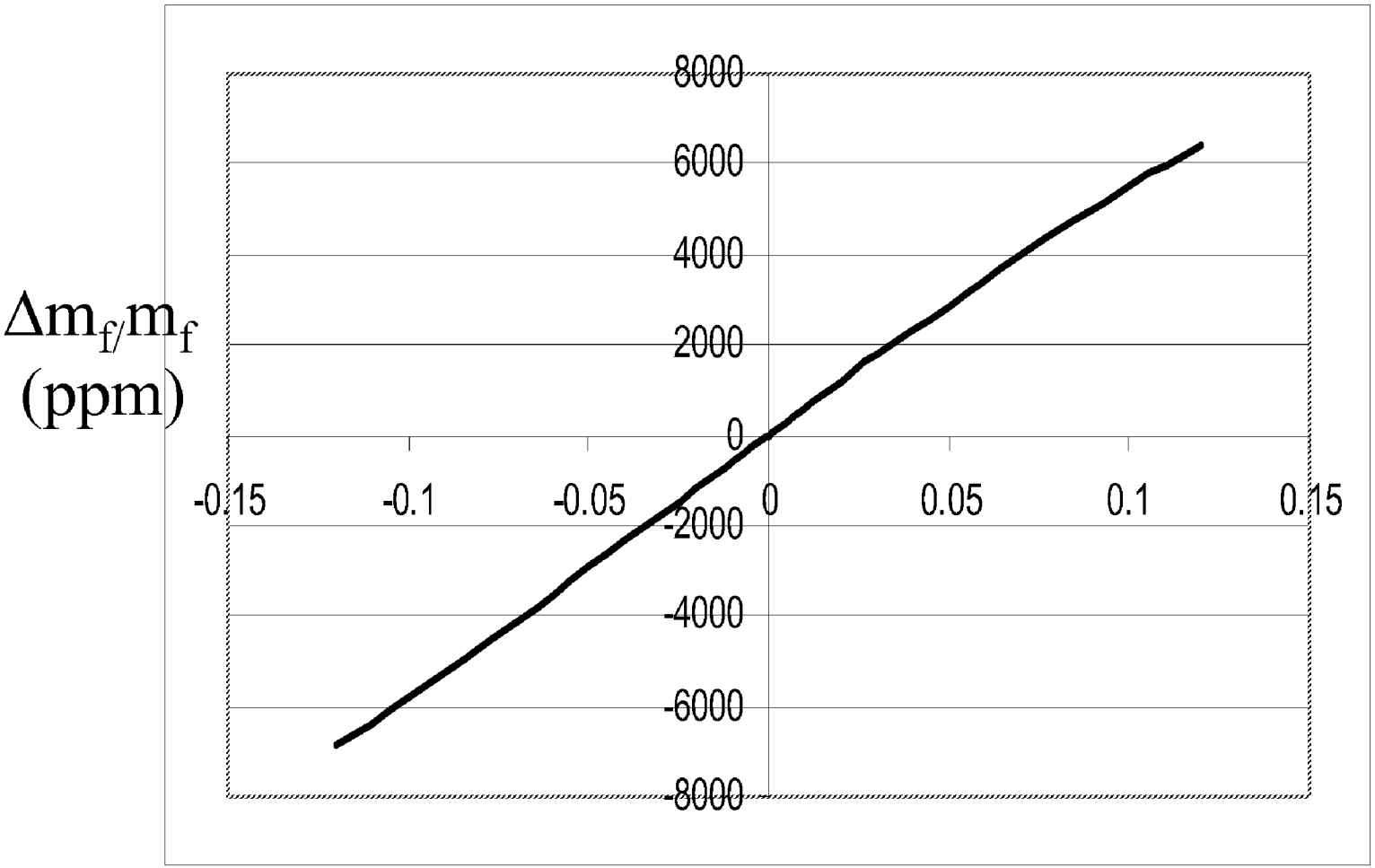
FIG. 15 is a graph illustrating the variation in apparent mass defect as a function of presumed precursor mass relative to the correct precursor mass for source effective length of 200 mm.
Figure 16:
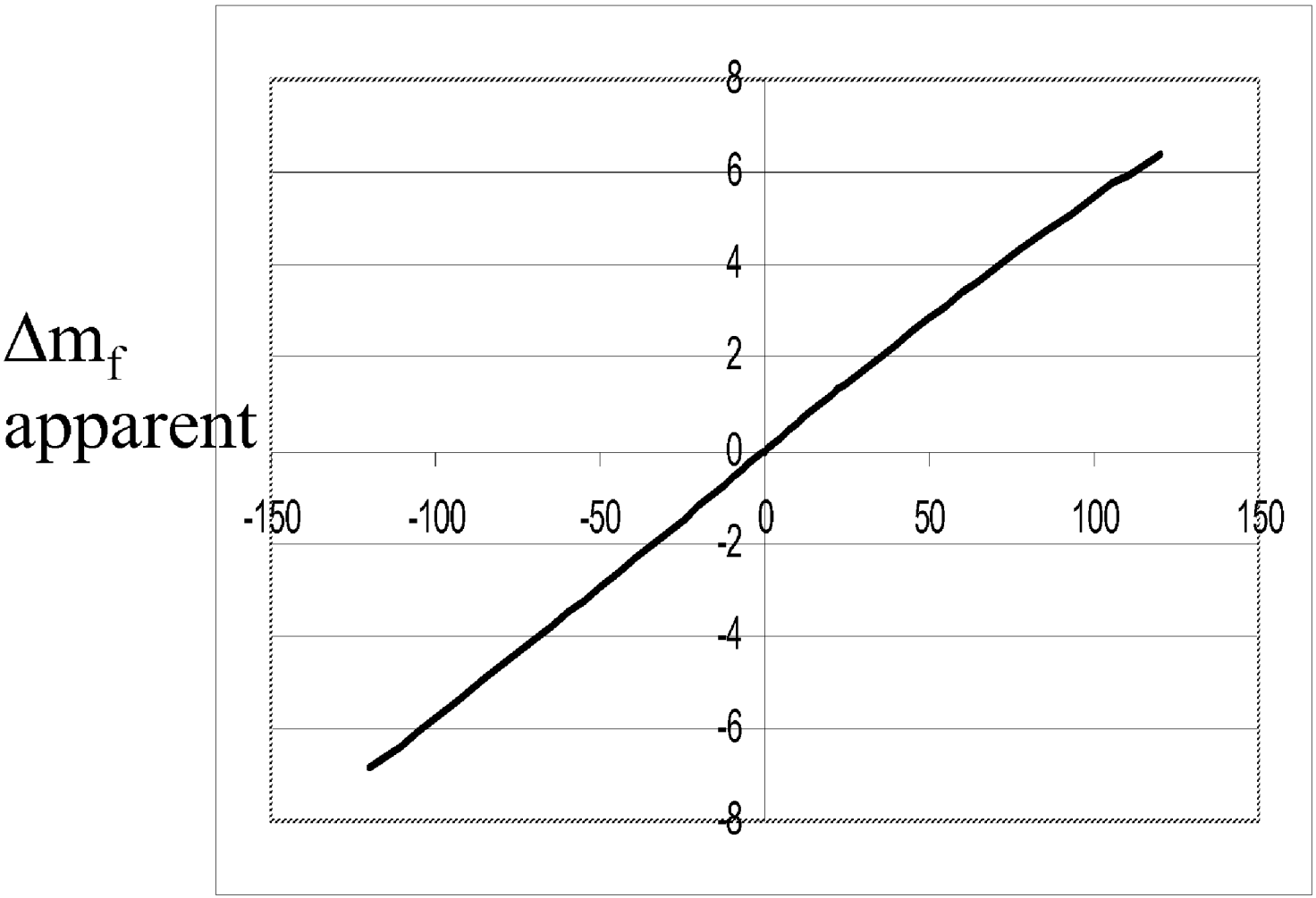
FIG. 16 is a graph illustrating the apparent change in fragment mass as a function of change in precursor mass calculated for $m_{p0}$=1000, R=0.5 and $m_f$=500 for effective source length 200 mm.
Figure 17:
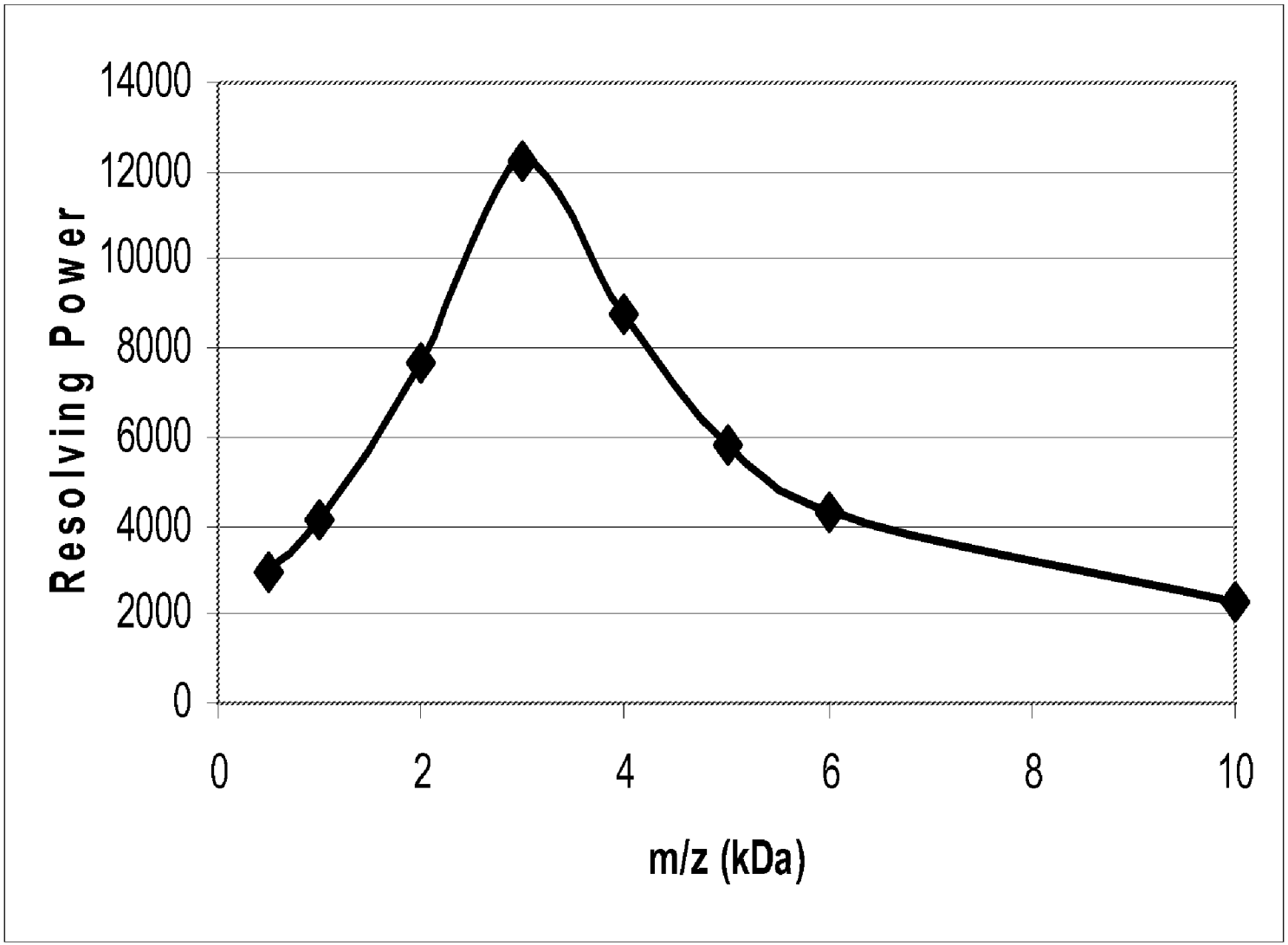
FIG. 17 is a graph illustrating the calculated resolving power for MS with an alternative geometry focused at 3 kDa.

An embodiment using a 2-field source is illustrated in FIG. 14 where the source focus has been increased to 200 mm and the mirror focus reduced to 1000 mm with $d_3$ and $d_4^0$ for the mirror reduced in proportion to 62.5 mm. The apparent error in fragment mass as a function of error in precursor mass is illustrated in FIGS. 15 and 16. This geometry should allow determining the correct precursor mass for each fragment to an accuracy of about 1 part in 1000. The relatively large apparent mass shift with precursor mass may allow some accidental degeneracy to occur, but the probability is expected to be rather low unless a large number of overlapping spectra are involved. The disadvantage of this geometry is that the resolving power as a function of precursor mass, shown in FIG. 17, is substantially reduced relative to that obtained with the shorter source focus shown in FIG. 9.

Determination of Fragment Peaks for Each Precursor

For each precursor a flight time $t(m_p)$ is uniquely determined for each $m_p$ included in the set of peaks transmitted by the timed ion selector. All fragment peaks with flight times between 0.85 and 1.125 times $t(m_p)$ are possible fragments of that precursor for each value of R. The variable q is computed for each fragment via equation (34) for the geometry with the 24 mm source focal length $$q=[t(m_f)/t(m_p)-0.671]/0.329=3.400[t(m_f)/t(m_p)]-2.400 \quad (54)$$

with the constants determined by the calibration procedures described above. For the alternative geometry with 200 mm source focal length $$q=[t(m_f)/t(m_p)-0.7059]/0.2941=3.400[t(m_f)/t(m_p)]-2.400 \quad (55)$$

The apparent fragment mass is then given by $$m_f=m_p(3Ry^2)/[4y-1] \quad (56)$$

If the apparent fragment mass is within the accepted range of possible mass defects and if the peak satisfies the peak width and intensity criteria, then it is added to the fragment peak table for that precursor. In cases where there are closely spaced precursors, a peak may be tentatively included in more than one precursor fragment peak table. In each case the exact mass determined corresponding to that precursor is the value included in that table.

Performance of the Analyzer with 200 mm Source Focus

By increasing the relative length of the source the ability to discriminate between potential precursor masses for a given fragment is improved, but the basic resolving power of the MS instrument is somewhat reduced; however, for most applications it is still adequate.

The important parameters determining resolving power in this case are as follows:

$$R_{s1}=(158/1700)(0.01/13.2)=7.0\times10^{-5}\ R_{s1}^{-1}=14{,}200$$

$$R_{v1}=[4(13.2)/1700](0.01\ m^{1/2})=3.11\times10^{-4}\ m^{1/2}\ R_{v1}^{-1}=3{,}220\ m^{-1/2}$$

$$R_{v3}=(26.2/158)^3(0.01\ m^{1/2})^3=4.7\times10^{-9}\ m^{3/2}\ R_{v3}=2\times10^8\ m^{-3/2}$$

$$R_t=m^{1/2}/[2(1.5)(0.041)]/1700]=7.2\times10^{-5}\ m^{-1/2}\ R_t^{-1}=13{,}700\ m^{1/2}$$

$$R_R=\Delta m/m=2\{[t(m_f/m_pR)/t(1)]-1\}[(2d_sy/(D_v-D_s)]\delta v_0$$

$$R_R(max)=(0.07)(0.304)(0.01\ m^{1/2})=2.12\times10^{-4}\ m^{1/2}\ R_R^{-1}(min)=4{,}700\ m^{-1/2}$$

Calculated resolving power as a function of m/z is shown in FIG. 17, and resolving power as a function of fragment mass relative fragment mass is presented in Table 4. Resolving Power as a function of $m_f/m_pR$ over the range of focus of the mirror for precursor masses between 0.5 and 10 kDa for the alternative geometry is shown. Isotopic resolution is achieved over the entire range for precursors less than 2 kda, and over most of the range up to 3 kda. Resolving power at masses below approximately 2 kDa can be improved by about a factor of 2 by focusing the source at lower mass.

TABLE 4

Resolving power as a function of fragment mass

| | mf/mp R = 1 | | | | | | | | |
|---|---|---|---|---|---|---|---|---|---|
| Mass | 0 | 0.01 | 0.02 | 0.03 | 0.04 | 0.05 | 0.06 | 0.07 | 0.08 |
| 0.5 | 2970 | 2960 | 2940 | 2910 | 2860 | 2810 | 2740 | 2670 | 2600 |
| 1 | 4100 | 4060 | 3960 | 3800 | 3600 | 3400 | 3180 | 2980 | 2780 |
| 2 | 7680 | 7230 | 6240 | 5230 | 4390 | 3740 | 3240 | 2840 | 2530 |
| 3 | 12,200 | 10,070 | 7110 | 5260 | 4120 | 3360 | 2840 | 2450 | 2150 |
| 4 | 8,800 | 7,600 | 5740 | 4380 | 3480 | 2860 | 2430 | 2100 | 1850 |
| 5 | 5820 | 5,350 | 4430 | 3570 | 2930 | 2450 | 2100 | 1840 | 1630 |
| 6 | 4340 | 4,100 | 3550 | 2990 | 2520 | 2150 | 1860 | 1640 | 1460 |
| 10 | 2270 | 2,210 | 2050 | 1850 | 1650 | 1460 | 1300 | 1170 | 1060 |

Analyzer Geometry Design

Figure 18:
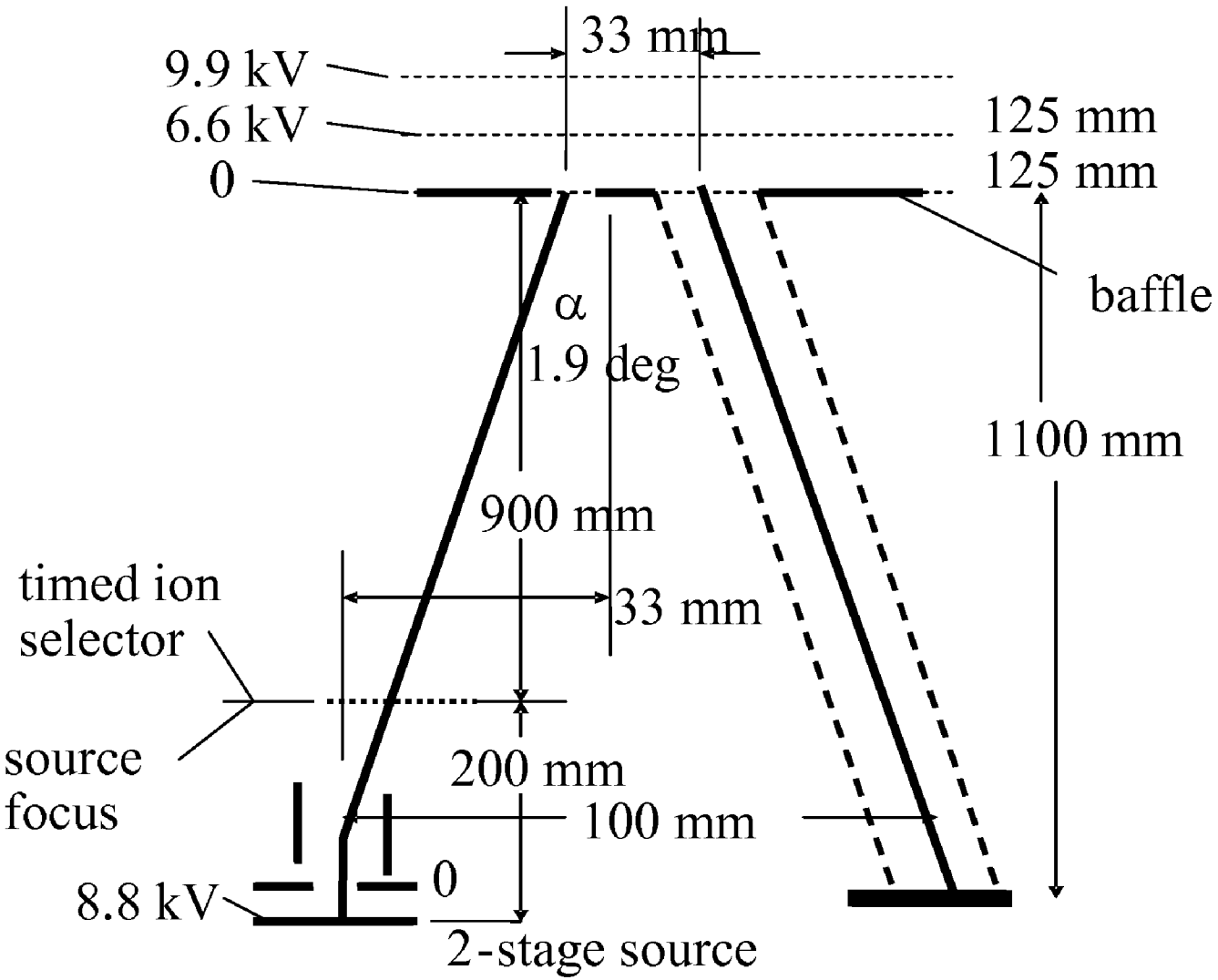
FIG. 18 is a schematic of one embodiment of the invention with 200 mm source focal length and 3200 mm overall effective length.

Increasing the source focal length improves the ability to discriminate between precursors for a particular fragment, but reduces the overall resolving power for an instrument of the same overall dimensions as discussed above. However, the resolving power can be at least partially restored by placing the detector near the source and increasing the length of the mirror. This geometry is illustrated in FIG. 18.

For this geometry, $C=(D_{es}+D)/1.5\ D+D_{es})=0.6875$ $$q=[t(m_f)/t(m_p)-0.6875]/0.3125=3.200[t(m_f)/t(m_p)]-2.200 \quad (57)$$

The apparent fragment mass is then given by $$m_f=m_p(3Rq^2)/[4q-1] \quad (58)$$

Performance of the Instrument

By increasing the relative length of the source the ability to discriminate between potential precursor masses for a given fragment is improved, and by also increasing the effective length of the reflecting analyzer the basic resolving power of the MS instrument is maintained. The important parameters determining resolving power in this case are as follows:

$$R_{s1}=(158/3200)(0.01/12)=4.1\times10^{-5}\ R_{s1}^{-1}=24{,}300$$

$$R_{v1}=[4(12)/3200](0.01\ m^{1/2})=1.5\times10^{-4}\ m^{1/2}\ R_{v1}1=6{,}670\ m^{-1/2}$$

$$R_{v3}=(24/158)^3(0.01\ m^{1/2})^3=3.5\times10^{-9}\ m^{3/2}\ R_{v3}^{-1}=2.85\times10^8\ m^{3/2}$$

$$R_t=m^{-1/2}/[2(1.5)(0.041)]/3200]=3.84\times10^{-5}\ m^{-1/2}\ R_t^{-1}=26{,}000\ m^{1/2}$$

$$R_R(max)=(0.07)(0.304)(0.01\ m^{1/2})=2.12\times10^{-4}\ m^{1/2}\ R_R^{-1}(min)=4{,}700\ m^{-1/2}$$

Figure 19:
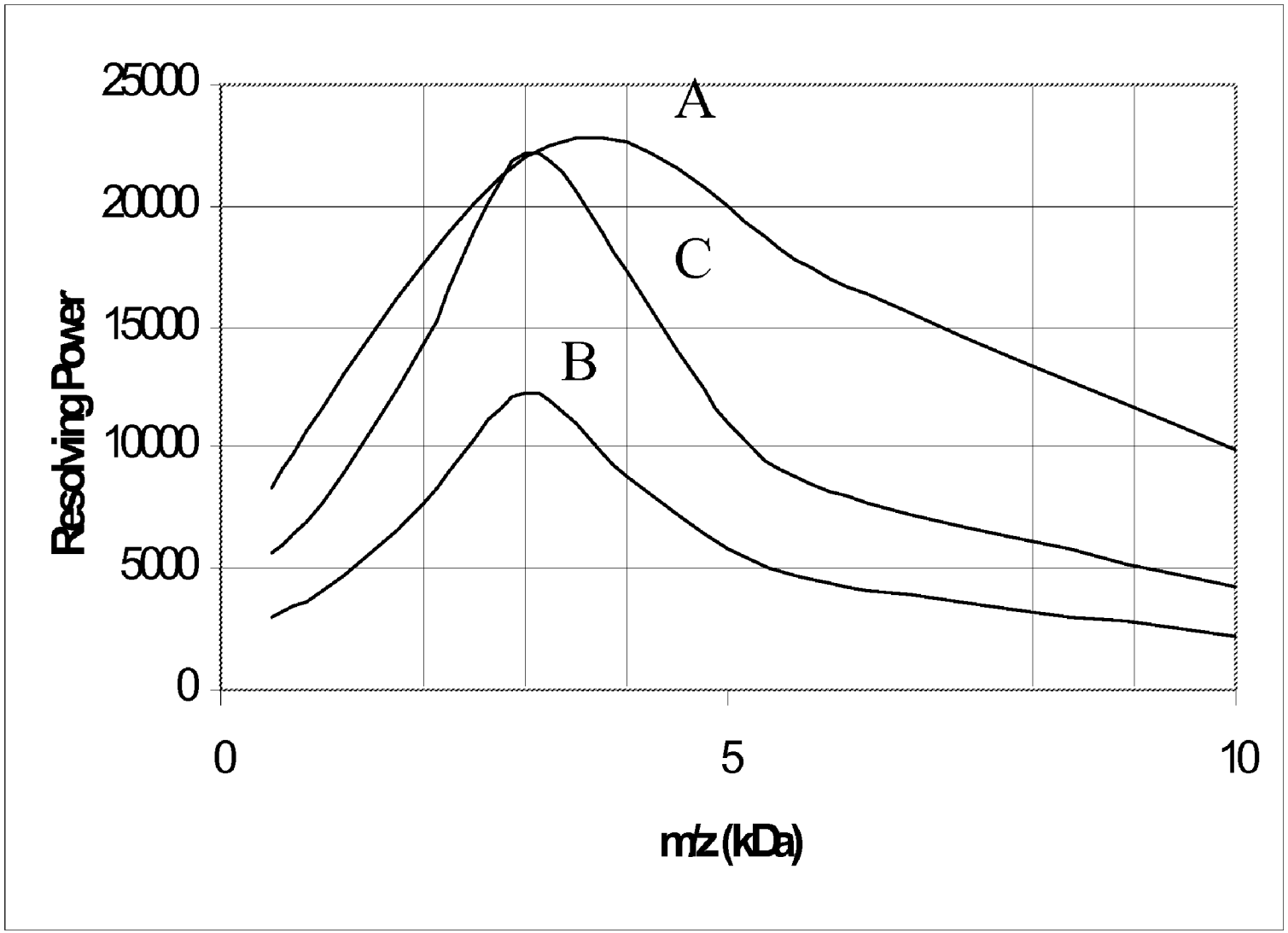
FIG. 19 is a graph of the calculated resolving power vs. m/z in MS for A: 20 mm source original; B 200 mm source original; C: 200 mm with 3200 mm effective length.

Calculated resolving power for precursor ions as a function of m/z is summarized as curve C in FIG. 19 where this result is compared with the configuration of FIG. 6, curve A and that of FIG. 14, curve B. Resolving power as function of fragment mass for different precursors is shown in Table 5. Resolving power as a function of $m_f/m_pR$ over the range of focus of the mirror for precursor masses between 0.5 and 10 kDa for the preferred geometry is shown. Isotopic resolution is achieved over the entire range for precursors less than 2 kda, and over most of the range up to 3 kda. Resolving power at masses below approximately 2 kDa can be improved by about a factor of 2 by focusing the source at lower mass.

TABLE 5

Resolving power as a function of fragment mass

| | mf/mp R = 1 | | | | | | | | |
|---|---|---|---|---|---|---|---|---|---|
| Mass | 0 | 0.01 | 0.02 | 0.03 | 0.04 | 0.05 | 0.06 | 0.07 | 0.08 |
| 0.5 | 5630 | 5590 | 5470 | 5290 | 5070 | 4815 | 4555 | 4300 | 4040 |
| 1 | 7720 | 7515 | 6990 | 6300 | 5630 | 5000 | 4470 | 4010 | 3630 |
| 2 | 14330 | 12200 | 9030 | 6820 | 5390 | 4420 | 3740 | 3240 | 2850 |
| 3 | 22240 | 14440 | 8730 | 6090 | 4640 | 3740 | 3130 | 2690 | 2360 |
| 4 | 17230 | 11900 | 7420 | 5225 | 4000 | 3230 | 2710 | 2330 | 2040 |
| 5 | 10940 | 8780 | 6100 | 4475 | 3490 | 2840 | 2390 | 2060 | 1810 |
| 6 | 8170 | 6980 | 5190 | 3925 | 3105 | 2550 | 2160 | 1870 | 1640 |
| 10 | 4290 | 3965 | 3310 | 2700 | 2220 | 1870 | 1610 | 1400 | 1245 |

Precursor Scanning

The configuration illustrated in FIG. 18 is a preferred embodiment for determining and quantifying the molecular ions fragmenting to produce a particular fragment. An example is the phosphatydal cholines that fragment in positive ion mode to give a characteristic fragment at m/z 184. Another example is ITRAQ labeled peptides where fragment ions at m/z 114, 115, 116, and 117 are detected to quantify the relative intensity of labeled peptides in a mixture. In normal precursor scanning the masses of the precursors are selected sequentially, and the intensity of a selected fragment ion or ions is determined for each precursor. In the present invention all of the precursor ions within a selected mass range can be selected, and the selected fragment ion or ions from each can be measured simultaneously. For a particular range of precursor ions the mirror ratio R is set to correspond to the selected fragment ion and a precursor ion in the center of the selected range. Thus $$R=m_f^0/m_p^0 \tag{59}$$

And the shift in flight time for fragment ion $m_f^0$ from any other precursor $m_p$ relative to that for $m_p^0$ is given by $$\Delta t(m_p,m_f^0)/t(m_p^0)=(D_{es}/2D_e)(m_p-m_p^0)/m_p^0 \tag{60}$$

For the embodiment illustrated in FIG. 18, $D_{es}$=200 mm, D=2000 mm, and $D_e$=3200 mm. The shift in flight time for fragment ion $m_f$ relative to that for $m_f^0$ for a given precursor $m_p^0$ is given to first order by $$\Delta t(m_f,m_p^0)/t(m_p^0)=(0.75D/D_e)(m_f-m_f^0)/m_f^0 \tag{61}$$

The range of precursor ions that can be monitored simultaneously without overlap between adjacent fragment ions can be estimated setting (60) equal to (61) with $$m_f-m_f^0=0.5 \tag{62}$$

This gives $$\Delta m_p/m_p^0=1.5D/(D_{es}m_f^0)=7.5/m_f^0 \tag{63}$$

In one example, $m_f^0$=184, $m_p^0$=736, and R=0.25. Then $\Delta m_p$=736(7.5/184)=30. Thus the 184 fragment from all precursors in the range from 721 to 751 can be measured in a single acquisition with no interference from fragments at 185 or 183. In cases where the fragment of interest is expected to be very intense relative to adjacent peaks the range of precursor ions selected can be expanded to at least +/−5% of the nominal precursor selected. Thus, in this case a range of m/z 700-770 can be acquired in a single acquisition.

At lower fragment mass a broader range of precursor masses can be scanned simultaneous, but when multiple fragment ions are measured, as in the case with ITRAQ the precursor range must be limited to avoid overlap between adjacent fragment ions. For example with ITRAQ the relative range of precursors is approximately 7.5/117=0.064. Thus all precursors in the range between m/z 1000 and 2000 can be quantified in 11 acquisitions, and the range between 2000 and 4000 using an additional 11 acquisitions. ($1.064^{11}$=2). Since each acquisition requires at most 0.4 seconds (2000 laser shots) a complete precursor scan from m/z 1000 to 4000 can be completed in about 8.8 seconds, corresponding to a scanning rate of 340 Da/sec.

Neutral Loss

The major difference between precursor scanning and neutral loss scanning is that in the latter the ratio of fragment mass to precursor mass is generally higher, thus requiring higher values of the mirror ratio R. The range of precursor masses that can be sampled without overlapping fragment ions can be calculated from equation (63) with $R=m_f^0/m_p^0$ to give $$\Delta m_p/m_p^0=1.5D/(D_{es}m_f^0)=7.5/Rm_p^0 \text{ or } \Delta m_p=7.5/R \tag{64}$$

Thus a maximum precursor window only 7 or 8 mass units wide can be employed at high value of R without spectral overlap. However the width of the total mass window that can be focused at a given value of R is proportional to the nominal focus mass. Thus at ca. m/z 1000 a fragment mass range more than 200 Da wide can be simultaneously focused. If the timed ion selector is set to transmit multiple mass windows ca. 8 mass units wide with spaces of ca. 8 mass units separating these, then all of the fragments from all of the precursors corresponding to a given value of R can be acquired in at most 2 or 3 acquisitions, and there is no ambiguity in assigning fragments to the correct precursors.

Multiple Reaction Monitoring

In multiple reaction monitoring one or more fragment ions from each of several predetermined precursor ions are monitored. In conventional MS-MS systems, a precursor ion is selected by a first MS, the precursor ion is caused to fragment, a predetermined fragment ion is selected by a second MS and the intensity of the fragment ion recorded. A second pair of precursor and fragment ions is selected and the measurement is repeated until all of the predetermined precursor and fragment pairs have been measured. This method is generally employed with chromatographic separation; thus it is essential that the complete set of measurements is accomplished in a time less than that of the peak width in the chromatogram.

The present invention allows a number of precursor and fragments ions to be monitored simultaneously. Each set of precursor and fragment ions can be measured simultaneously that satisfy the condition $$0.88R<m_f/m_p<1.12R \quad (65)$$

In some cases it may be necessary to limit the range of precursor ions measured, as described above, to limit the possibility of overlapping fragment ions. In many applications the range of precursor and fragment masses required is rather small so that a single value of R and a single acquisition can be employed to monitor the complete set. In other cases covering wider mass ranges it may be necessary to employ multiple acquisitions using several different R values.

While this invention has been particularly shown and described with references to preferred embodiments thereof, it will be understood by those skilled in the art that various changes in form and details may be made therein without departing from the scope of the invention encompassed by the appended claims.

What is claimed is:

1. A time-of-flight mass spectrometer comprising:

a. an evacuated ion source housing configured to receive a MALDI sample plate;

b. a pulsed ion source located within the ion source housing c. an analyzer vacuum housing;

d. a gate valve having an aperture through which a laser beam passes when said gate valve is open and wherein said gate valve is located between and operably connecting said evacuated ion source housing and said analyzer vacuum housing and wherein said gate valve is maintained at or near ground potential;

e. a field-free drift region maintained at or near ground potential located within said analyzer vacuum housing and aligned to receive an ion beam from the evacuated ion source housing;

f. a two-stage ion mirror located in the end of said analyzer vacuum housing opposite the gate valve;

g. a computer-controlled high voltage supply operably connected to each stage of said two-stage mirror h. a baffle adjacent to said two-stage ion mirror, said baffle comprising entrance and exit apertures which act to limit the diameter and location of the ion beam entering or exiting said baffle; and i. an ion detector located within the field free drift region configured to receive ions from the baffle.

2. The time-of-flight mass spectrometer of claim 1 further comprising:

a. a pulsed laser beam directed to strike the MALDI sample plate and produce a pulse of ions;

b. a high voltage pulse generator operably connected to the pulsed ion source; and c. a time delay generator providing a predetermined time delay.

3. The time-of-flight mass spectrometer of claim 2 having a predetermined time delay comprising an uncertainty which is not more than 1 nanosecond.

4. The time-of-flight mass spectrometer of claim 2 wherein the physical length of each stage of the two-stage ion mirror is equal to 1/16 of the length of the field-free region less the focal length of an ion source.

5. The time-of-flight mass spectrometer of claim 2 wherein the electric field strength of a first stage of the ion mirror is substantially equal to three times the field strength of a second stage.

6. The time-of-flight mass spectrometer of claim 2 wherein the transverse distance from the pulsed laser beam to the center line of the ion detector is between 50 and 150 mm.

7. The time-of-flight mass spectrometer of claim 2 wherein the high voltage operably connected to the first stage of the ion mirror is substantially equal to three quarters of the ion source accelerating potential and the high voltage connected to the second stage of the ion mirror is substantially equal to 1.5 times the voltage operably connected to the first stage.

8. The time-of-flight mass spectrometer of claim 1 further comprising a timed-ion selector located within the field-free region between the pulsed ion source and the two-stage ion mirror.

9. A method for determining mass spectra of fragment ions from multiple precursor ions using the mass spectrometer of claim 8 comprising:

a. setting the high voltages operably connected to the two-stage ion mirror to predetermined values that focus precursor masses at the detector, acquiring time of flight spectra, and applying predetermined calibration factors to determine masses of all precursors;

b. reducing the high voltages operably connected to the two-stage ion mirror so that the flight time of a fragment ion with mass that is a predetermined fraction R of the precursor ion mass is substantially identical to the flight time of the precursor ion with the predetermined high voltages operably connected to the two-stage mirror;

c. activating the timed-ion-selector to select one or more precursor mass ranges following each laser pulse;

d. acquiring time-of-flight spectra for all fragment ions with mass ratios within a predetermined range of R for all precursor ions selected; and e. interpreting said time-of-flight spectra to determine the masses of all detected fragment ions and assign the fragments to the correct precursor.

10. A method according to claim 9 wherein said mass ratios are between 0.88 and 1.12 times the predetermined fraction R.

11. A method according to claim 9 wherein fragment ions from precursor masses differing by a factor of 1.3 or less are assigned to the correct precursor by consideration of apparent mass defect of the fragment ion.

12. A method according to claim 9 wherein fragment ions from precursor masses differing by a factor of 1.3 or less are assigned to the correct precursor by consideration of the intensity of the fragment ion relative to the intensity of the precursor.

13. A method according to claim 9 wherein fragment ions from precursor masses differing by a factor of 1.3 or less are assigned to the correct precursor by consideration of the width of the fragment ion peak relative to the width of the precursor peak.

14. The time-of-flight mass spectrometer of claim 1 further comprising one or more ion optical elements for spatially focusing an ion beam.

15. The time-of-flight mass spectrometer of claim 14 wherein said one or more ion optical elements each comprise an extraction electrode at in close proximity to the MALDI sample plate and a first ion lens located between the pulsed ion source and the gate valve.

16. The time-of-flight mass spectrometer of claim 15 wherein each of the ion lenses comprise either an einzel lens or a cathode lens.

17. The time-of-flight mass spectrometer of claim 15 further comprising one or more pairs of deflection electrodes located in the field-free region at ground with any pair energized to deflect ions in either of two orthogonal directions.

18. The time-of-flight mass spectrometer of claim 16 wherein at least one of the deflection electrodes of any pair of deflection electrodes is energized by a time-dependent voltage resulting in the deflection of ions in one or more selected mass ranges.

19. A method for determining mass spectra of fragment ions from multiple precursor ions using the mass spectrometer of claim 1 comprising:

a. setting the high voltages operably connected to the two-stage ion mirror to predetermined values that focus precursor masses at the detector, acquiring time of flight spectra, and applying predetermined calibration factors to determine masses of all precursors;

b. reducing the high voltages operably connected to the two-stage ion mirror so that the flight time of a fragment ion with mass that is a predetermined fraction R of the precursor ion mass is substantially identical to the flight time of the precursor ion with the predetermined high voltages operably connected to the two-stage ion mirror;

c. acquiring time-of-flight spectra for all fragment ions with mass ratios within a predetermined range about R for all precursor ions; and d. interpreting said time-of-flight spectra to determine the masses of all detected fragment ions and assign the fragments to the correct precursor.

20. A method according to claim 19 wherein said mass ratios are between 0.88 and 1.12 times the predetermined fraction R.

21. A method for determining mass of a fragment ion from a predetermined precursor ion using the mass spectrometer of claim 19 wherein the mass of the fragment ion is accurately determined from time-of-flight spectra by inversion of a substantially exact equation for the time-of-flight as a function of precursor mass and fragment mass.

22. A method according to claim 19 wherein fragment ions from precursor masses differing by a factor of 1.3 or less are assigned to the correct precursor by consideration of apparent mass defect of the fragment ion.

23. A method according to claim 19 wherein fragment ions from precursor masses differing by a factor of 1.3 or less are assigned to the correct precursor by consideration of the intensity of the fragment ion relative to the intensity of the precursor.

24. A method according to claim 19 wherein fragment ions from precursor masses differing by a factor of 1.3 or less are assigned to the correct precursor by consideration of the width of the fragment ion peak relative to the width of the precursor peak.

* * * * *